US009120586B1

(12) United States Patent
Sullivan

(10) Patent No.: US 9,120,586 B1
(45) Date of Patent: Sep. 1, 2015

(54) APPARATUS AND METHOD FOR BALING PAPER AND CARDBOARD

(71) Applicant: Raymond Sullivan, Royal Oak, MI (US)

(72) Inventor: Raymond Sullivan, Royal Oak, MI (US)

( * ) Notice: Subject to any disclaimer, the term of this patent is extended or adjusted under 35 U.S.C. 154(b) by 0 days.

(21) Appl. No.: 14/461,353

(22) Filed: Aug. 15, 2014

Related U.S. Application Data

(60) Provisional application No. 61/870,199, filed on Aug. 26, 2013.

(51) Int. Cl.

| | |
|---|---|
| ***B65B 27/08*** | (2006.01) |
| ***B65B 13/02*** | (2006.01) |
| ***B65B 13/18*** | (2006.01) |
| ***B65B 13/20*** | (2006.01) |

(52) U.S. Cl.
CPC ..... *B65B 27/08* (2013.01); *B65B 13/025* (2013.01); *B65B 13/183* (2013.01); *B65B 13/20* (2013.01)

(58) Field of Classification Search
CPC ..... B65B 27/00; B65B 27/08; B65B 27/083; B65B 13/025; B65B 13/183; B65B 13/20
USPC ..... 100/2, 3, 6, 8, 12, 24, 34, 94, 98 R, 98 A, 100/265
See application file for complete search history.

(56) References Cited

U.S. PATENT DOCUMENTS

| | | | | | |
|---|---|---|---|---|---|
| 1,037,781 | A | * | 9/1912 | Longdon | 100/7 |
| 3,139,814 | A | * | 7/1964 | Sanders | 100/34 |
| 4,006,678 | A | * | 2/1977 | Laurie et al. | 100/1 |
| 4,068,576 | A | | 1/1978 | Smith | |
| 4,095,560 | A | | 6/1978 | Laurie et al. | |
| 4,288,999 | A | * | 9/1981 | Sterling et al. | 68/13 R |
| 4,403,543 | A | | 9/1983 | Sanders | |
| 5,582,098 | A | | 12/1996 | Clinton | |

* cited by examiner

*Primary Examiner* — Jimmy T Nguyen
(74) *Attorney, Agent, or Firm* — Singh Law Firm, PLLC; Gautam B. Singh

(57) ABSTRACT

An apparatus and method for stacking and binding flattened cardboard or cellulose material into a bale is disclosed. The apparatus disclosed is anticipated for use in recycling paper and cardboard. The apparatus uses a post or a sleeve with a piercing element for perforating the cardboard sheets and holding them in a stack as they accumulate. Cord is routed through the stack of papers, cardboard, or other cellulose materials fastens the stack by with the help of anchoring elements attached to the ends of the cord. The apparatus uses a ram for facilitating the process of forcing the pieces down the post or the sleeve. Additionally, the apparatus is mounted on a stand adapted to match with the type of materials being baled and the stand can be mounted on a surface such as a wall.

20 Claims, 14 Drawing Sheets

APPARATUS AND METHOD FOR BALING PAPER AND CARDBOARD

CROSS REFERENCE TO RELATED APPLICATIONS

The application claims the benefits of provisional patent application Ser. No. 61/870,199 filed on Aug. 26, 2013, by the present inventor and is incorporated herewith by reference.

FIELD OF THE INVENTION

The disclosed invention is generally within the field of bale forming devices and discloses a method and apparatus for cardboard baling.

BACKGROUND OF THE INVENTION

The present invention is a device for binding multiple cardboard sheets, such as flattened boxes, into a bale for disposal or recycling. The device is compact, inexpensive, and imposes practically no limitations on the size of the cardboard sheets that make up the bale. The device performs optimally even when the size of the material being baled varies widely within the same bale.

Significant aspects and features of the present invention include a binding method whereby cord passes through the body of each cardboard sheet of the bale and, therefore, through the bale. An anchoring element is fastened to each end of the cord retaining the material on the cord between the anchoring elements. The binding method represents a departure from prior art methods in which at least a portion of the cord wraps around the perimeter of the bale.

Another significant aspect and feature of the present invention is a baler comprising multiple, removable parts, which are quickly and easily assembled and disassembled by hand into various configurations before, during, and after construction of the bale. Changeability of the state of assembly allows the device to be optimally configured at each step of the baling process.

SUMMARY OF THE INVENTION

The present invention is a device for binding multiple cardboard sheets, such as flattened boxes, into a bale for disposal or recycling. The device is compact, inexpensive, and imposes practically no limitations on the size of the cardboard sheets that make up the bale. The device performs optimally even when the size of the material being baled varies widely within the same bale.

Cardboard balers disclosed in prior art have been large and complex machines or impose explicit or implicit limitations on the size of the cardboard sheets that make up the bale. Large, complex machines can also be costly and not accessible to normal household consumers. Further, since the cardboard sheet sizes encountered in normal daily use vary significantly in size, imposing limitations in cardboard sheet size make these balers unsuitable for baling use by consumer. Even when the baling apparatus disclosed in the prior art is simple and affordable, the apparatus generally restricts the baled material to be roughly of similar size for optimal performance.

What is needed is a baling apparatus that is appropriate for daily use and allows the baling of cardboard and other cellulose pieces of a plurality of sizes, shapes and thickness. What is also needed is a baling apparatus that is detachable and easy to store. What is needed is a baling apparatus that is easy to assemble and store. What is also needed is an apparatus for baling that is cost effective and affordable and easy to use.

Significant aspects and features of the present invention include a binding method whereby cord passes through the body of each cardboard sheet of the bale and, therefore, through the bale. An anchoring element is fastened to each end of the cord retaining the material on the cord between the anchoring elements. The binding method represents a departure from prior art methods in which at least a portion of the cord wraps around the perimeter of the bale.

Another significant aspect and feature of the present invention is a baler comprising multiple, removable parts, which are quickly and easily assembled and disassembled by hand into various configurations before, during, and after construction of the bale. Changeability of the state of assembly allows the device to be optimally configured at each step of the baling process.

BRIEF DESCRIPTION OF THE DRAWINGS

The invention will be described in conjunction with the attached drawings in which referenced numerals designate elements, and wherein.

DETAILED DESCRIPTION OF THE INVENTION

The invention disclosed in this application is an apparatus and method for baling arbitrarily shaped pieces of cardboard, or other material that is easy to pierce. The invention comprises of a post with a piercing end adapted to receive a plurality of cardboard pieces of arbitrary shapes and sizes. A twine, rope, cord or a similar anchoring element is inserted through the holes pierced through the cardboard. A user uses a ram with a grip for providing mechanical advantage when pushing bales down so that compact bales are formed.

Figure 1:
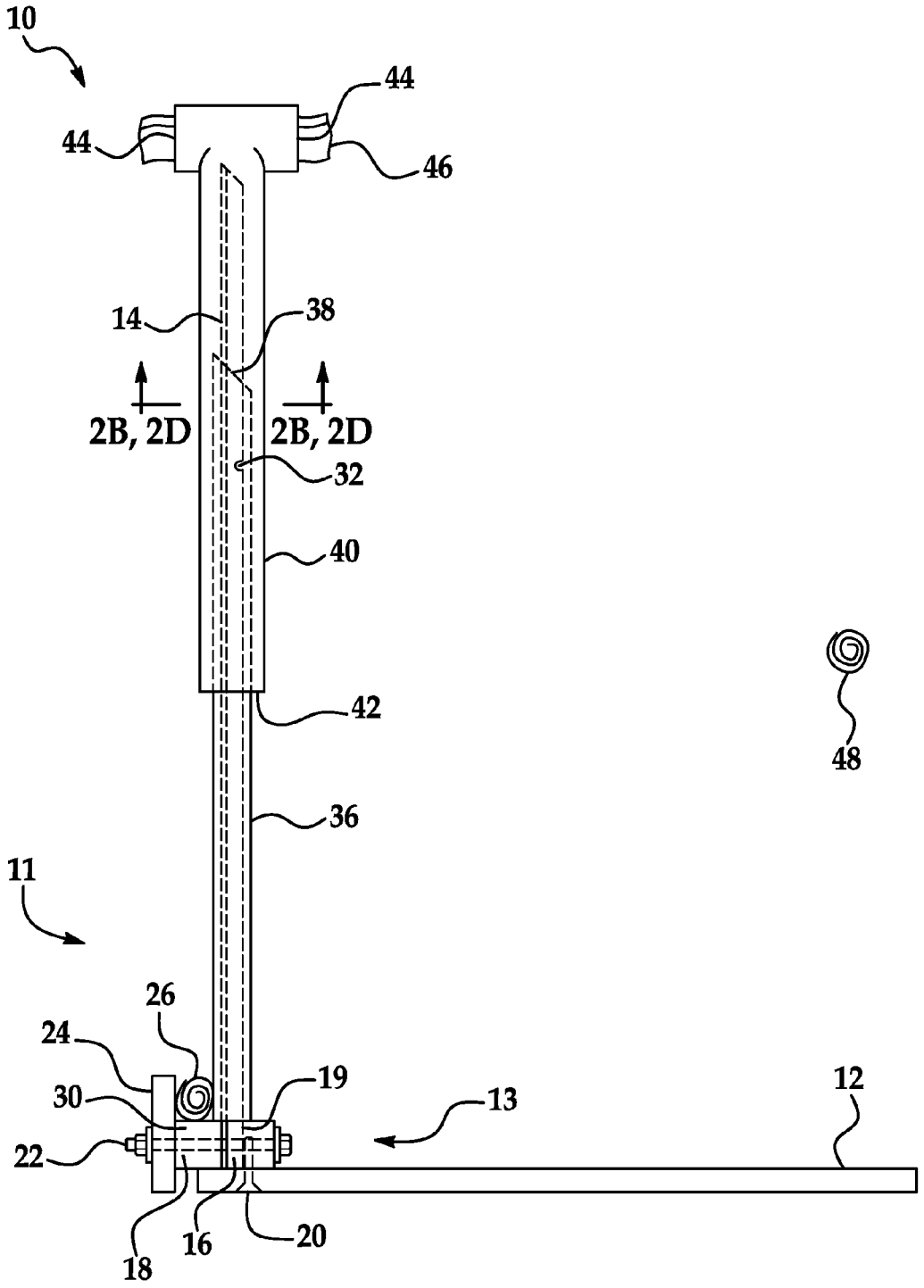
FIG. 1 is a sectional view of an embodiment of the baling apparatus.

FIG. 1 illustrates an assembled side view of an embodiment of the invention 10, including a clamp assembly 13. The stationary jaw 16 is fixedly attached to the base 12 using a fastener 20. A screwable fastener 22 connecting the stationary jaw 16 and the movable jaw 18 is adapted to generate predetermined force to optimally engage and thereby fixedly retain post 14 when the baler 10 is assembled to perform the baling process. The first anchoring element 26 is one of two anchoring elements between which the bale is constrained. The first anchoring element 26 may be, for example, a piece of cardboard that is rolled into a generally cylindrical shape. Attached to the first anchoring element 26 is a cord 28 having sufficient length to provide two free ends after the cord 28 is fastened to the post 14 at the notch 32.

Figure 2A:
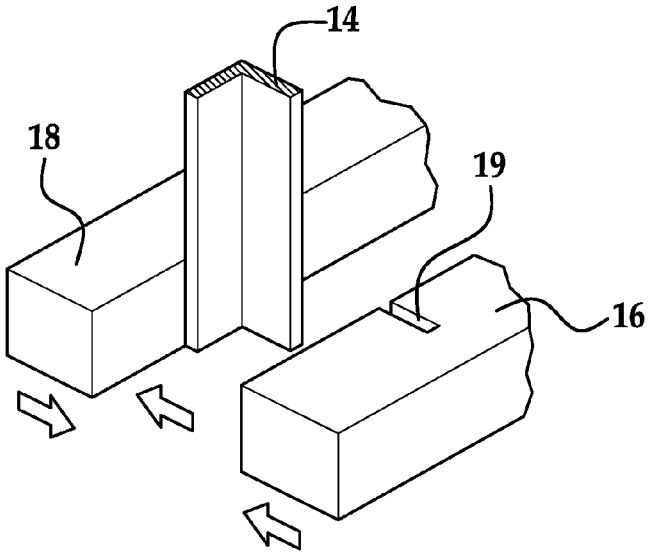
FIGS. 2A and 2B are isometric and plan view of an L-shaped post and the complementary slot in the movable jaw adapted to accommodate it.
Figure 2B:
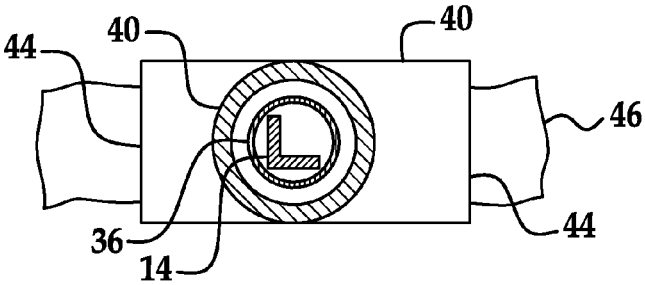
Figure 2C:
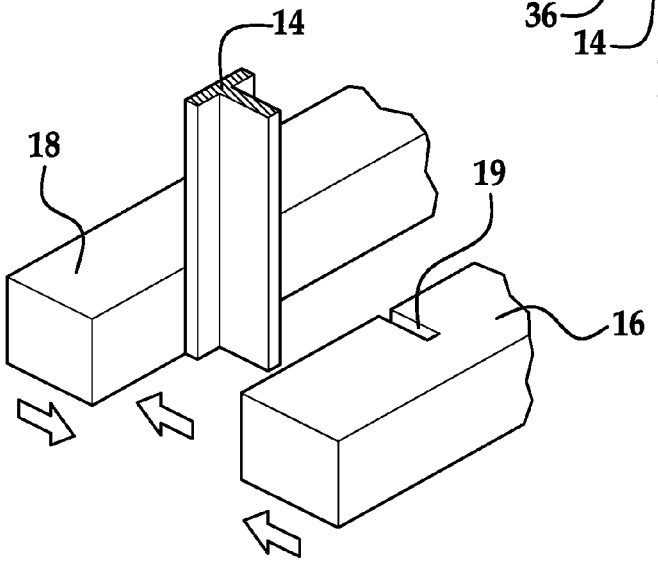
FIGS. 2C and 2D are isometric and plan view of an T-shaped post and the complementary slot in the movable jaw adapted to accommodate it.
Figure 2D:
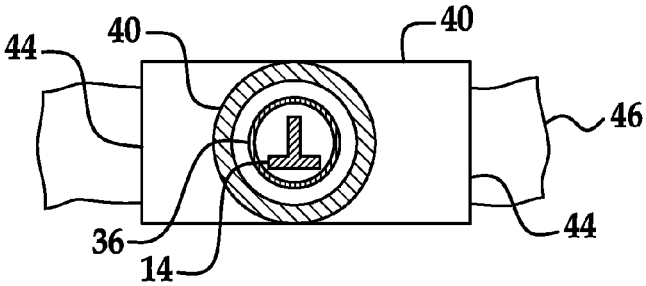

An embodiment of the clamp assembly 13 illustrated in FIG. 2A and FIG. 2B comprises of an L-shaped post 14 sandwiched between a movable jaw 18 and a stationary jaw 16. One arm of the L-shaped post is inserted into the slot 19 included in the stationary jaw 16. An embodiment of clamp assembly 13 illustrated in FIGS. 2C and 2D comprises a stationary jaw 16, a movable jaw 18, and a T-shaped post 14. The inner surfaces of the stationary jaw 16 and movable jaw 18 (e.g. the surface on each jaw that faces the other jaw) are in substantially parallel planes where the space between the two parallel surfaces is adapted to engage post 14.

Figure 3:
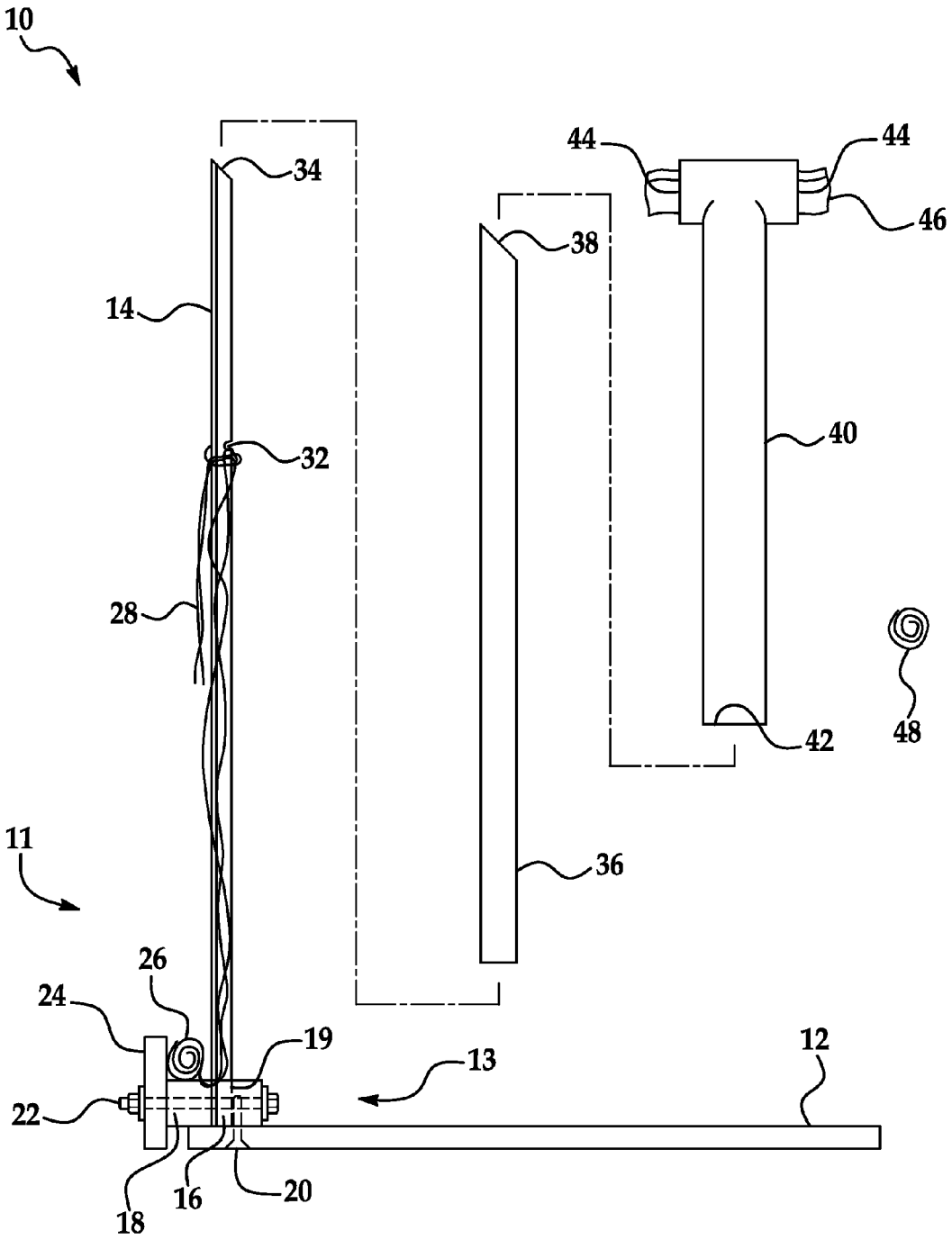
FIG. 3 is an exploded view of the components used in an embodiment of the baling apparatus.

In the embodiment of the invention shown in FIGS. 1 and 3, a sleeve 36 comprises a rigid cylindrical wall defining an interior region with an opening at both ends. The sleeve 36 is removably disposed over the post 14, being supported at the proximal end by the stand 11. The sleeve 36 is cut at an angle at its distal end 38, the angle ranging from fifteen degrees (15°) to ninety degrees (90°) relative to the sleeve axis. The cord 28 is routed through a first defined space that provides a protected passageway between the post 14 and the sleeve 36. The first defined space prevents cardboard sheets 56 from abrading the cord 28 when cardboard sheets are slid over the post 14 toward the base 12. The first defined space is defined by the cavity between the post 14 and the inner wall of the sleeve 36 through which the cord 28 is routed.

The cord 28 is routed through a second defined space that provides a protected passageway between the region outside the sleeve 36 and the region inside the sleeve 36. The second defined space prevents the sleeve 36 from pinching the cord 28 when the sleeve 36 is disposed over the post 14. The second defined space may be provided by a slot 30 formed in a surface of a clamp jaw, the slot 30 extending from the region outside the area circumscribed by the wall of the sleeve 36 to the region inside the area circumscribed by the wall of the sleeve 36, thereby forming an opening between the sleeve 36 and the clamp 13 through which the cord 28 can pass.

An apparatus for baling cardboard comprising a base; a post having a primal end, a middle section, and a distal end where the primal end, the middle section and the distal end are linearly disposed, and the primal end of the post is attached to the base and the post has a notch; a cord of predetermined length having a first end and a second end and adapted to run through a bale of cardboard where the first end of the cord is attached to a first anchoring element and the second end of the cord is attached to the notch in the post; a sleeve having a primal end and a distal end with the primal end of the sleeve adapted to cover the primal end of the post and the distal end of the sleeve adapted to cover the post, where the sleeve is substantially shaped as a hollow cylinder having a diameter and a length where the diameter of the sleeve is adapted to include within the hollow cavity the post and a cord attached thereupon, and the length of the sleeve is adapted to cover the post; and a second anchoring element adapted to attach to the second end of the cord.

An embodiment of the apparatus for baling cardboard has a jaw attached to the base where the jaw includes a housing cavity and the post is inserted into the housing cavity of the jaw, wherein the conformation of the post and jaw attached to the base includes an angle between the base and the post, and the included angle between the post and the base ranges between fifteen (15) degrees to ninety (90) degrees.

An embodiment of the apparatus for baling cardboard has a piercing element disposed over the distal end of the post with the piercing element comprising of a tapered feature where the piercing element is attached to and supported by the distal end of the post and includes a pointed contour with the pointed contour extending beyond the distal end of the post.

An embodiment of the apparatus for baling cardboard has a piercing element disposed over the distal end of the sleeve with the piercing element comprising of a tapered feature where the piercing element is attached to and supported by the distal end of the sleeve and includes a pointed contour with the pointed contour extending beyond the distal end of the post.

An embodiment of the apparatus for baling cardboard including a first defined space where the first defined space is formed by the region between the post and the sleeve, and a portion of the cord is run alongside the post and through the first defined space.

An embodiment of the apparatus for baling cardboard has a jaw attached to the base where the jaw includes a housing cavity and the post is inserted into the housing cavity of the jaw, with the post having a cross section shape and where the cross section shape of the post has a shape of an "L" and wherein the housing cavity in the jaw is adapted to receive the post with the "L" cross section shape.

An embodiment of the apparatus for baling cardboard has a jaw attached to the base where the jaw includes a housing cavity and the post is inserted into the housing cavity of the jaw, with the post having a cross section shape and where the cross section shape of the post has a shape of an "T" and wherein the hollow cavity in the jaw is adapted to receive the post with the "T" cross section shape.

An embodiment of the apparatus for baling cardboard has a base where the includes a surface and a device for mounting and the base on a mounting surface where the device for mounting the base on the mounting surface includes a plurality of fasteners that pierce through the base surface and insert into the mounting surface thereby fastening the base and the mounting surface.

An embodiment of the apparatus for baling cardboard has a base that has a shape selected from a group consisting of a circle, an ellipse, a rectangle, a trapezoid and a square.

An embodiment of the apparatus for baling cardboard has a jaw a jaw attached to the base where the jaw includes a housing cavity and the post is inserted into the housing cavity of the jaw, wherein the jaw comprises of a stationary jaw portion and a movable jaw portion where the stationary jaw portion is fixedly attached to the base; the movable jaw portion has a first end and a second end where the first end of the movable jaw portion is detachably attached to a fence and the second end the movable jaw portion is detachably attached to the stationary jaw portion; and the attachment of the movable jaw portion and the stationary jaw portion includes the housing cavity.

An embodiment of the apparatus for baling cardboard that comprises of a fastening mechanism for fixedly attaching the stationary jaw portion to the base; the movable jaw portion and the stationary jaw portion each having a surface where the surfaces come into a contact with each other creating a hollow cavity that is complimentarily shaped and adapted to accommodate the post to fully engage and occupy the hollow cavity; a clamping mechanism utilizing one or more threaded fasteners for attaching the movable jaw portion to the stationary jaw portion where the clamping mechanism is adapted to vary the force exerted by the movable jaw portion and the stationary jaw portion over the accommodated post.

An embodiment of the apparatus for baling cardboard that comprises of a movable jaw portion having a jaw height and a left end and a right end where the right end of the movable jaw portion engages the stationary jaw portion and the left end of the movable jaw portion includes a fence having a fence height where the fence height is larger than the jaw height; the fence attached to the left end of the movable jaw portion with the clamp; and the fence height is adapted to restrain a first anchoring element in close proximity to the post.

Figure 4:
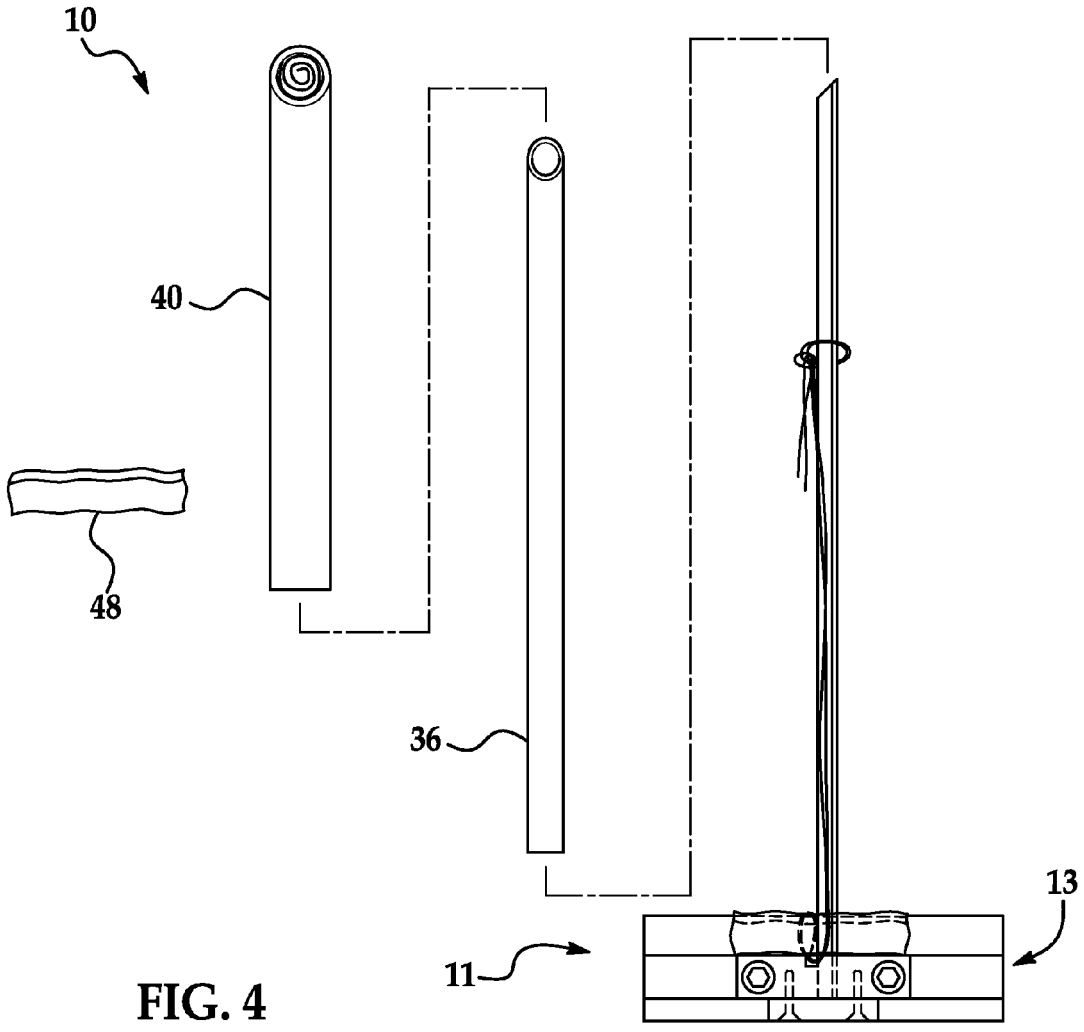
FIG. 4 is an exploded elevation view of an embodiment of the invention.

As illustrated in FIGS. 3 and 4, a ram 40 comprises a rigid tubular wall defining an interior region with three openings to the ambient atmosphere. The ram 40 is removably disposed over a portion of the post 14 and sleeve 36. The ram 40 has an upper tubular portion and a lower tubular portion, the two portions being disposed at right angles, as in the shape of a capital letter T. The upper tubular portion corresponds to the horizontal stroke in the capital letter T and the lower tubular portion corresponds to the vertical stroke in the capital letter T. The upper tubular portion and lower tubular portion are joined so as to form a single interior cavity in the shape of a T, the cavity open to the ambient atmosphere at both ends of the upper tubular portion 44 and at the bottom opening 42 of the lower tubular portion. Each opening is delineated by an edge adjacent to the inner tube wall and the outer tube wall. The bottom opening 42 may be delineated by an edge that is beveled such that the opening is larger at the outer wall than the inner wall. A compliant, shock-absorbing element 46 may occupy the cavity bounded by the walls of the upper tubular portion. The shock-absorbing element 46 is of sufficient length to extend entirely across the passageway leading from the upper tubular portion to the lower tubular portion and of sufficient breadth to fit snugly in the upper tubular portion.

An embodiment of the apparatus for baling cardboard includes a ram adapted to cover the sleeve and the post included therein and wherein the ram comprises an upper portion and a lower portion with each of the upper portion and the lower portion having a hollow cylindrical shape, where the upper portion and lower portion are fixedly attached so as form a shape of a letter "T" with the upper portion aligned with horizontal arm of the letter "T" and the lower portion aligned with vertical arm of the letter "T"; the upper portion is stuffed with compliant or shock absorbing material; and the lower portion having a top end and a bottom end where the top end of the lower portion is fixedly attached to the upper portion, and the lower end has an opening where the opening includes beveled edge circumscribing the perimeter of the opening.

Figure 5:
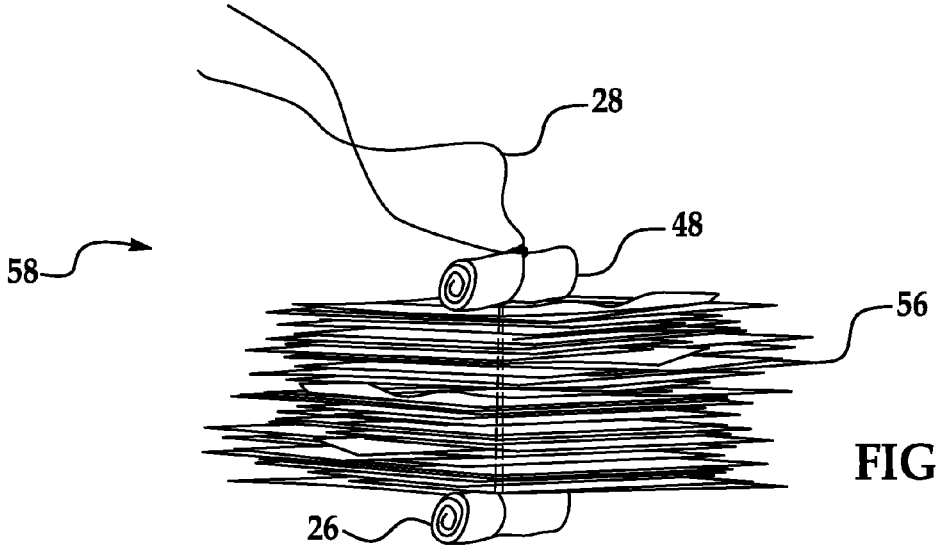
FIG. 5 is elevation view of a bale formed by using an embodiment of the invention.

Illustrated in FIG. 5 is a second anchoring element 48 attached to the free ends of cord 28 to complete the binding of the bale 58. The second anchoring element 48 may be, for example, a piece of cardboard that is rolled into a generally cylindrical shape. The second anchoring element 48 may be of similar construction to the first anchoring element 26 or of differing construction.

The post 14 has a piercing element 34 formed at its distal end. The proximal end the post 14 attaches to clamp 13. In an embodiment of the invention, the longitudinal cross section of the post 14 is generally L-shaped wherein the receptacle slot 19 within the clamp assembly 13 has predetermined width and depth to accommodate one leg of the L extends along the inner surface of the stationary jaw 16 while the inner surface of the movable jaw 18 is substantially planar. Threaded fasteners 22 situated on each side of the post 14 couples the jaws to each other. The threaded fasteners 22 draw the jaws toward each other when tightened, the threaded fasteners 22 being the tightening mechanism of the clamp 13. The fasteners 22 may be bolts and nuts, lag screws, or the like.

Additionally, a fence 24 may be secured adjacent the movable jaw 18. The fence 24 may be parallelepiped in shape having a length dimension and a height dimension in a plane disposed approximately parallel to the post 14. The height dimension is sufficient to extend above and below the movable jaw 18. The fence 24 extends below the movable jaw 18 by a distance equal to the height (thickness) of the base 12 such that the bottom of the fence 24 is in the same plane as the surface supporting the base 12. The length of the fence 24 may be greater than the width of the base 12, providing lateral stability to the baler 10 beyond that provided by the base 12 alone. The fence 24 extends above the movable jaw 18 by a distance sufficient to retain a first anchoring element 26 in the space bounded by the post 14, movable jaw 18, and fence 24.

Figure 6A:
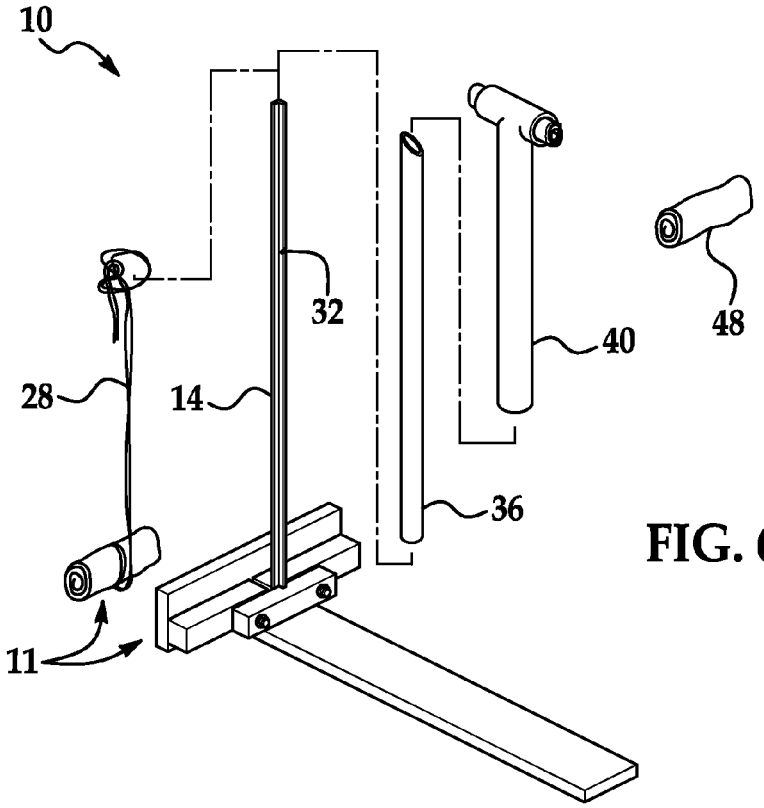
FIGS. 6A through 6E illustrate the steps in the process of stacking paper or cardboard in an embodiment of the invention.
Figure 6B:
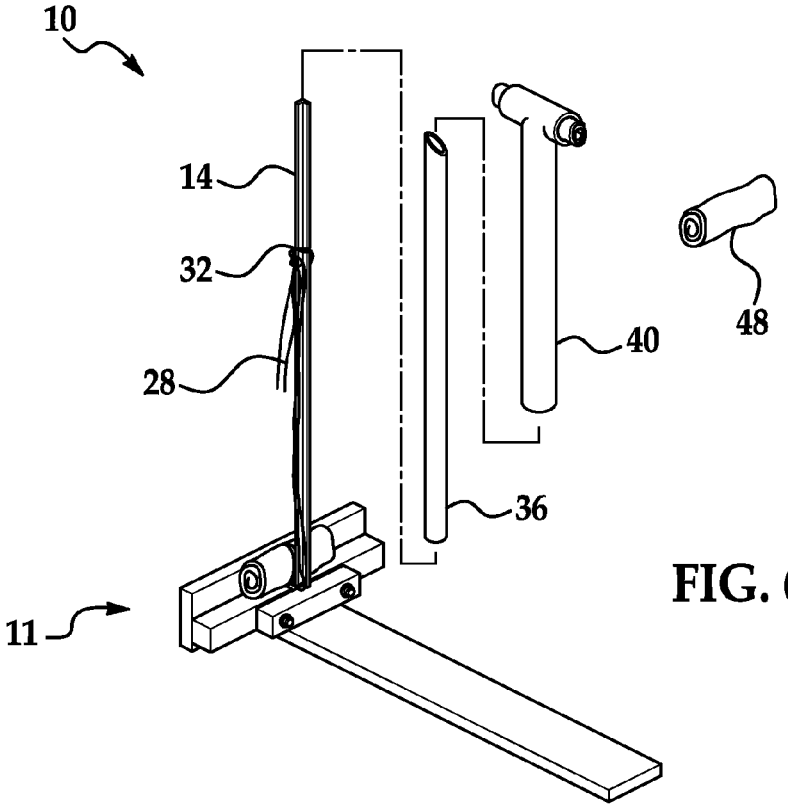
Figure 6C:
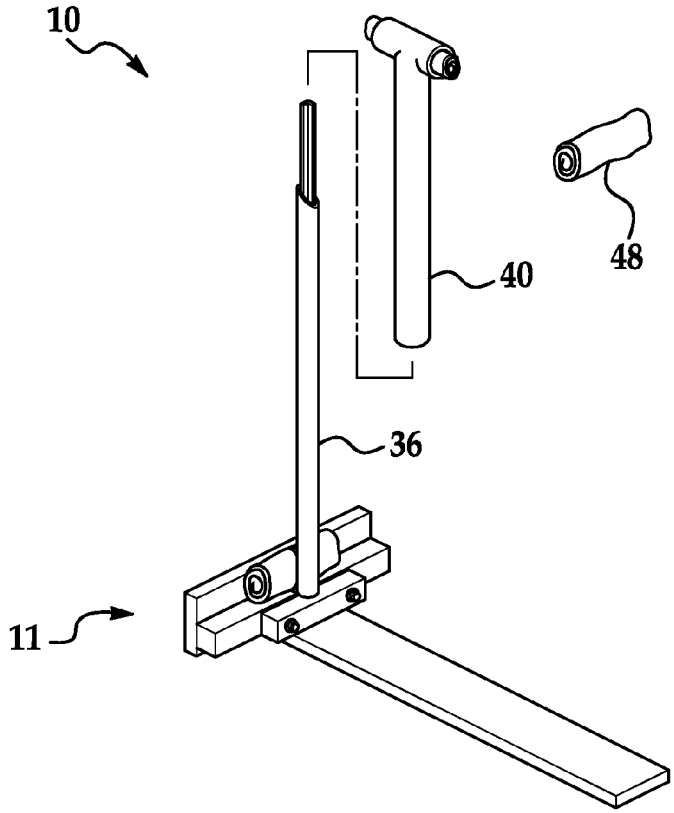
Figure 6D:
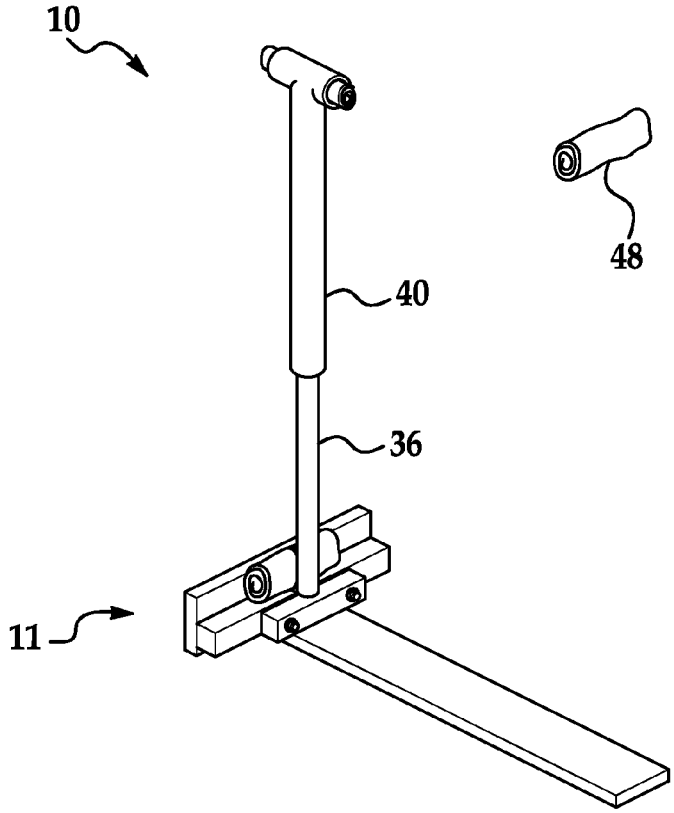

Illustrated in FIGS. 6A through 6E are the steps in the process of bale formation. Starting with FIG. 6A is where the post 14 is clamped between stationary jaw 16 and the movable jaw 18, with the fastener 22 tightened to a predetermined level to keep the post 14 in a fixedly upright position. Illustrated in FIG. 6B is a first anchoring element 26 with the attached cord 28 which is inserted into notch 32 wherein the first anchoring element 26 is seated into the stand 11. Next, as illustrated in FIG. 6C, the sleeve 36 is inserted over the post 14 where the sleeve 36 is adapted to be snugly cover the post 14. The sleeve 36 performs the function of providing a smooth surface that guide the sliding motion of ram 40, as well as provides a covering for keeping the cord 28 secure by preventing its movements against the thrusting actions of the ram. Illustrated in FIG. 6D is the dimensional compatibility of the baling components' assembly 10 with the ram 40 with a substantially cylindrical shape with a hollow interior having dimensions to snugly accommodate the sleeve 36 also having an approximately cylindrical shape with the hollow interior having dimensions adapted to snugly accommodate the post 14 and provide a covering for the attached cord 28 inserted into notch 32. In an embodiment of the invention the upward facing end of the sleeve 36 is shaped to pierce through the cardboard or paper pieces and facilitate the baling process.

Figure 6E:
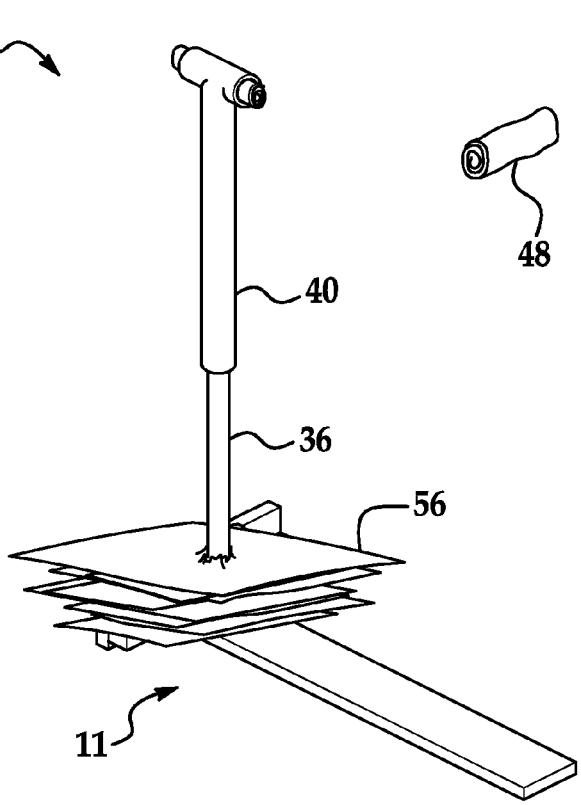

Illustrated in FIG. 6E is the step of adding plurality of cardboard or paper pieced to the bale 56 getting formed over the stand 11. One or more of the pieces of cardboards are pushed down over the sleeve 36 with the help of a ram 40 having one end with a substantially tubular portion containing a shock-absorbing element. The process of adding paper or cardboard with the help of a ram 40 moving downwards continues until the bale 56 achieves a predetermined size.

Figure 7A:
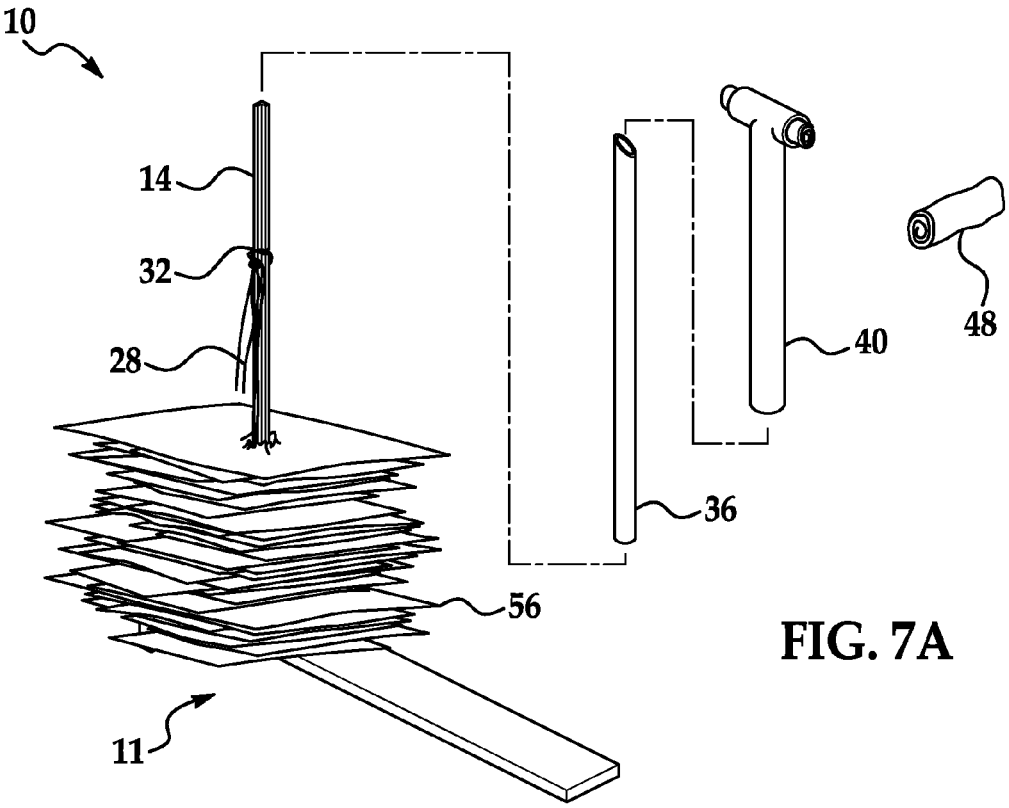
FIGS. 7A through 7G illustrate the steps in the process of removing the stacked paper or cardboard and creating a bale therefrom in an embodiment of the invention.
Figure 7B:
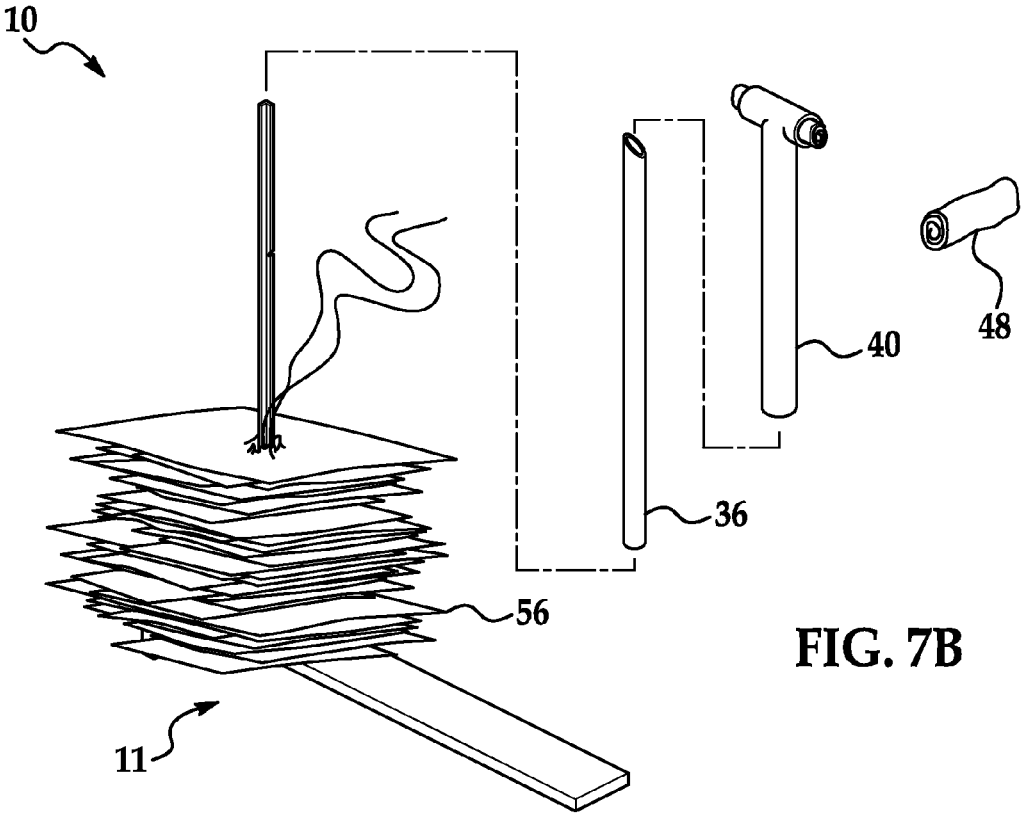
Figure 7C:
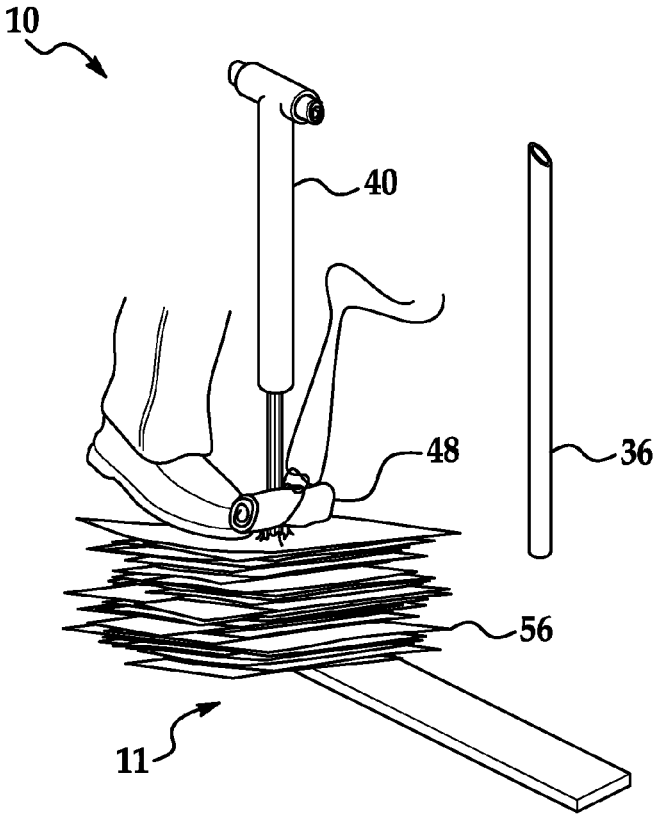
Figure 7D:
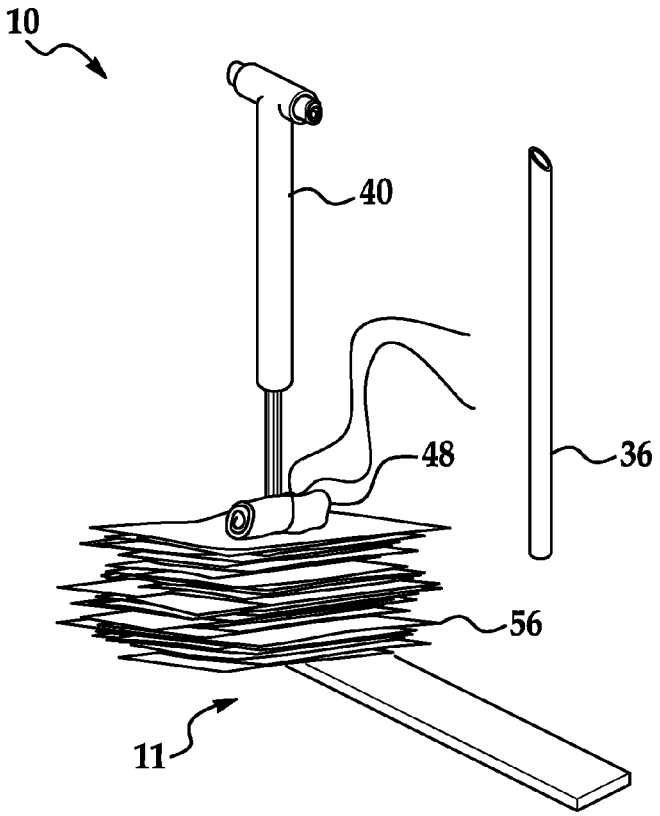
Figure 7E:
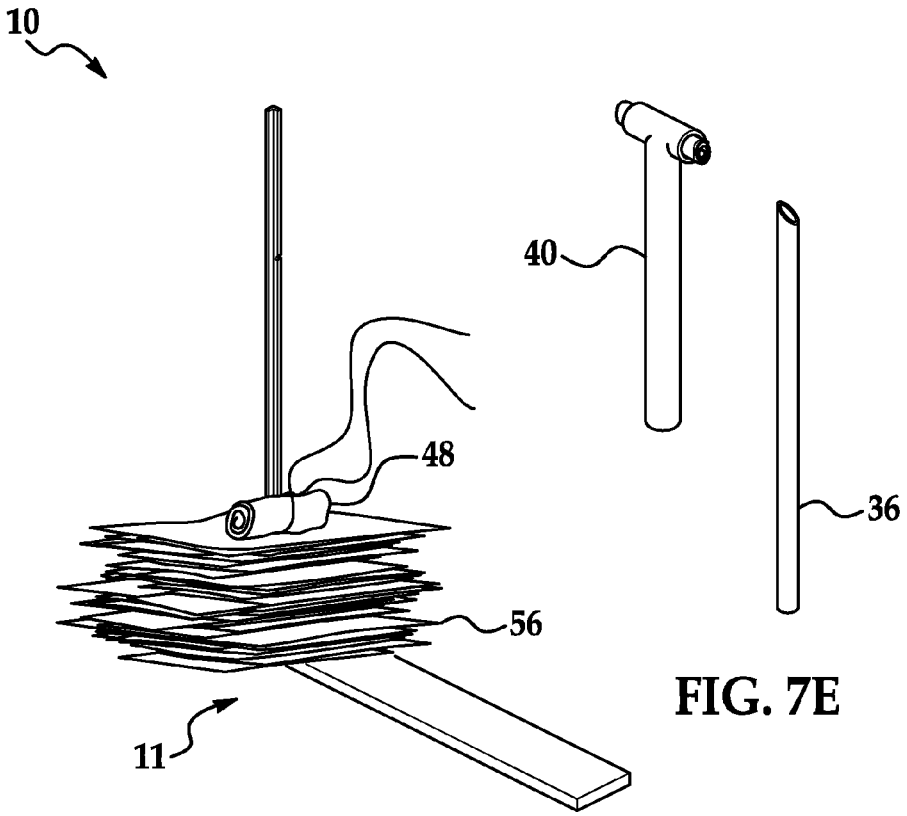

FIGS. 7A through 7G illustrate the steps in the process of removing the bale 56 from the apparatus disclosed. The first step in removing the bale is illustrated in FIG. 7A where the ram 40, and the sleeve 36 are removed from post 14 thereby exposing the cord 28 attached to the notch 32. Next, as illustrated in FIG. 7B, the cord 28 is removed from the notch 32. The second anchoring element 48 is then attached to the cord 28 while pressure, using a foot, is applied to the bale 56 to bring it into a substantially compressed conformation as illustrated in FIG. 7C. Pressure may also be applied using the ram 40 to bring the bale 56 into a substantially compressed conformation as illustrated in FIG. 7D. This leaves the bale 56 in a substantially compact conformation encompassed by the first anchoring element 26 on one end and a second anchoring element 48 at the other end where the two anchoring elements are connected with a cord 28 running through the baled cardboard or paper as shown in FIG. 7E.

Figure 7F:
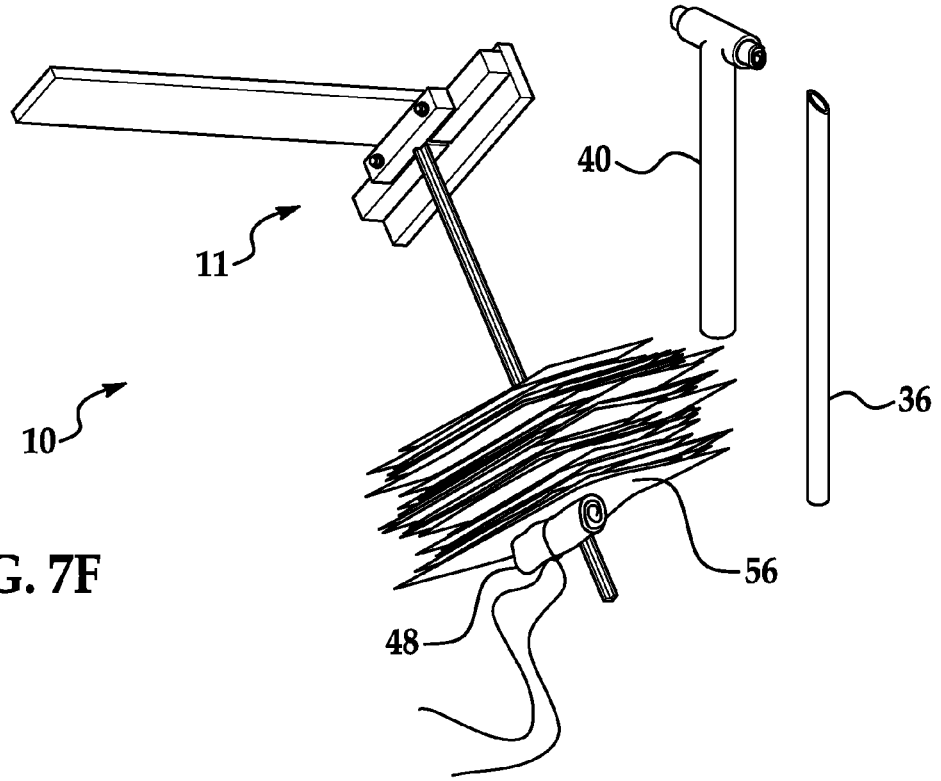
Figure 7G:
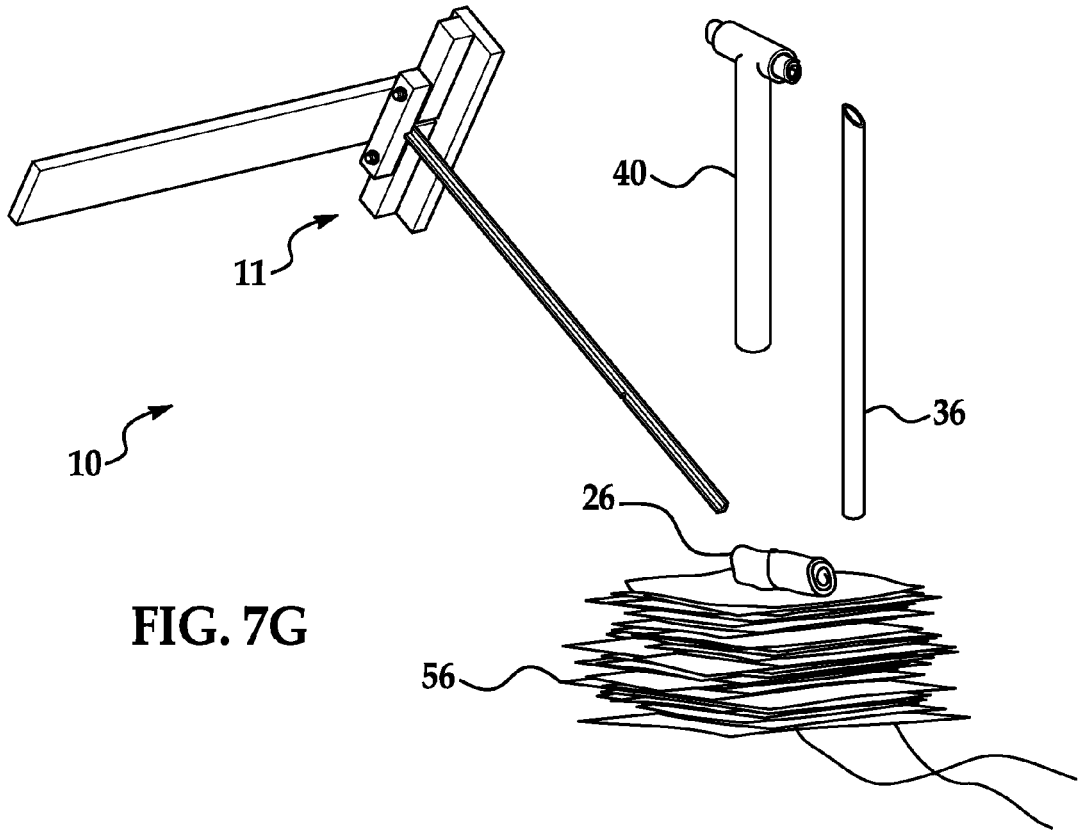

Illustrated in FIGS. 7F and 7G are the steps of dismounting the bale 56 from the baling apparatus 10. The bale having been formed, the stand 11 is turned over so that bale 56 glides down the post 14 under the force of gravity as illustrated in FIG. 7F. The stand 11 is returned to its normal upright position after the bale 56 is completely off the post 14 as illustrated in FIG. 7G.

An embodiment of the method for baling of material is disclosed where the method comprising the steps of providing an apparatus for baling cardboard or cellulosic material where the apparatus is comprised of a base, and a post having a length and a proximal end and a distal end, with the proximal end of the post attached to the base, a piercing element extending beyond the distal end of the post, a cord having a first end and a second end and predetermined length, the first end of the cord attached to a first anchoring element and connected to the primal end of the post, and the second end of the cord attached to a notch included on the post; providing a plurality of pieces of cardboard or cellulosic material to be baled; attaching the first end of the cord to the first anchoring element; routing the cord through a set of defined spaces along the post and attaching the cord to the notch on the post; impaling the plurality of pieces of cardboard or cellulosic material over the piercing element; sliding the plurality of pieces of cardboard or cellulosic material along the length of the post optionally with the help of a ram used for pushing the plurality of pieces of cardboard or cellulosic material down towards to the proximal end of the post thereby building a stack of the plurality of pieces of cardboard or cellulosic material at the proximal end of the post; compressing the stack of the plurality of pieces cardboard or cellulosic material with a predetermined force; detaching said cord from the notch on the post and attaching it to a second anchoring element thereby forming a bundle of the plurality of cardboard or cellulosic material compressed between the first and the second anchoring element; and removing the bundle from the post.

An embodiment of the method for baling of material is disclosed with the method comprising the steps of providing additional device components including a sleeve; installing the sleeve to cover the post prior to impaling the plurality of pieces of cardboard or cellulosic material over the piercing element; and removing the sleeve from the post after sliding the plurality of pieces of cardboard or cellulosic material along the length of the sleeve covering the post.

Figure 8:
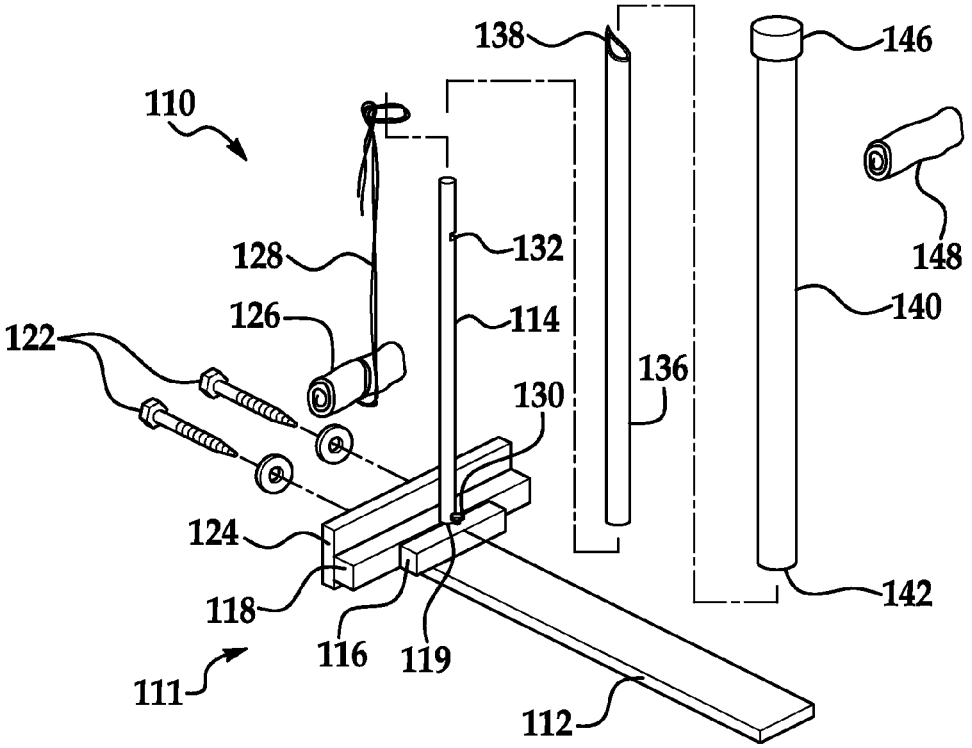
FIG. 8 illustrates an embodiment of the invention where the sleeve includes a piercing element.

An embodiment of the invention shown in FIG. 8 includes a plurality of fasteners 122 that attach movable jaw 118 and the stationary jaw 116. The stand 111 comprises of a post 114 extending from a base 112, a fence 124, a first anchoring element 126, and a cord 128. The sleeve 136 has two ends with one end resting on the stand 111 and the other including a sharp end designed to pierce through cardboard or paper needing to be baled. The ram 146 has a capped end, a substantially cylindrical shaped and a hollow interior adapted to slide over the post 114.

The post 114 is blunt at its distal end. Additionally, the post 114 attached to the base 112 in the slot 130 formed between stationary jaw 116 and movable jaw 118. The stationary jaw 116 is attached to the base 112 by any suitable means, for example with two screws 120. The inner surfaces of the stationary jaw 116 and movable jaw 118 (e.g. the surface on each jaw that faces the other jaw) are in substantially parallel planes. The force-applying region of the jaw inner surfaces may be shaped to optimally engage the post 114. Threaded fasteners 122 situated on each side of the post 114 couples the jaws to each other. The threaded fasteners 122 draw the jaws toward each other when tightened, the threaded fasteners 122 being the tightening mechanism of the clamp 113. The fasteners 122 may be bolts and nuts, lag screws, or the like.

Additionally, a fence 124 may be secured adjacent the movable jaw 118. The fence 124 may be parallelepiped in shape having a length dimension and a height dimension in a plane disposed approximately parallel to the post 114. The height dimension is sufficient to extend above and below the movable jaw 118. The fence 124 extends below the movable jaw 118 by a distance equal to the height (thickness) of the base 112 such that the bottom of the fence 124 is in the same plane as the surface supporting the base 112. The fence 124 extends above the movable jaw 118 by a distance sufficient to retain a first anchoring element 126 in the space bounded by the post 114, movable jaw 118, and fence 124.

The first anchoring element 126 is one of two anchoring elements between which the bale is constrained. The first anchoring element 126 may be, for example, a piece of cardboard that is rolled into a generally cylindrical shape. Attached to the first anchoring element 126 is a cord 128 having sufficient length to provide two free ends after the cord 128 is fastened to the post 114 at the notch 132.

A sleeve 136 comprises a rigid cylindrical wall defining an interior region with an opening at both ends. The sleeve 136 is removably disposed over all or part of the post 114. The sleeve 136 is supported at its proximal end by a standoff structure 130. The sleeve 136 is formed at its distal end into a piercing element 138, where the piercing element 138 is suitably contoured for piercing cardboard and guiding it onto the sleeve 136 where the sleeve 136 is longer than the post 114.

The cord 128 is routed through a first defined space that provides a protected passageway between the post 114 and the sleeve 136. The first defined space prevents cardboard sheets from abrading the cord 128 when cardboard sheets are slid over the post 114 toward the base 112. The first defined space is defined by the cavity between the inner wall of the sleeve 136 and the post 114 through which the cord 128 is routed. In the case where the sleeve 136 and post 114 both are circular in cross section, the cavity between them will be generally annular in cross section.

The cord 128 is routed through a second defined space that provides a protected passageway between the region outside the sleeve 136 and the region inside the sleeve 136. The second defined space prevents the sleeve 136 from pinching the cord 128 when the sleeve 136 is disposed over the post 114. The second defined space may be provided by a standoff structure that supports the sleeve 136 above the cord, such as a screw 130 or a formation integral to the clamp 113, for example, by making the stationary jaw 116 longer in one dimension than the movable jaw 118, the standoff structure forming an opening between the sleeve 136 and the stand 111 through which the cord can pass.

A ram 140 is removably disposed over the sleeve 136. The ram 140 comprises a rigid tubular wall defining an interior region with an opening 142 at one end and a cap 146 at the other end. The opening 142 may be delineated by an edge that is beveled such that the opening is larger at the outer wall than the inner wall. A second anchoring element 148 is attached to the free ends of cord 128 to complete the binding of the bale. In more detail, still referring to the invention of FIG. 8, the cardboard baler 110 includes both discardable and reusable components. Excluding the cardboard being baled, the discard able components are the first anchoring element 126, cord 128, and the second anchoring element 148. All other components are reusable.

Figure 9:
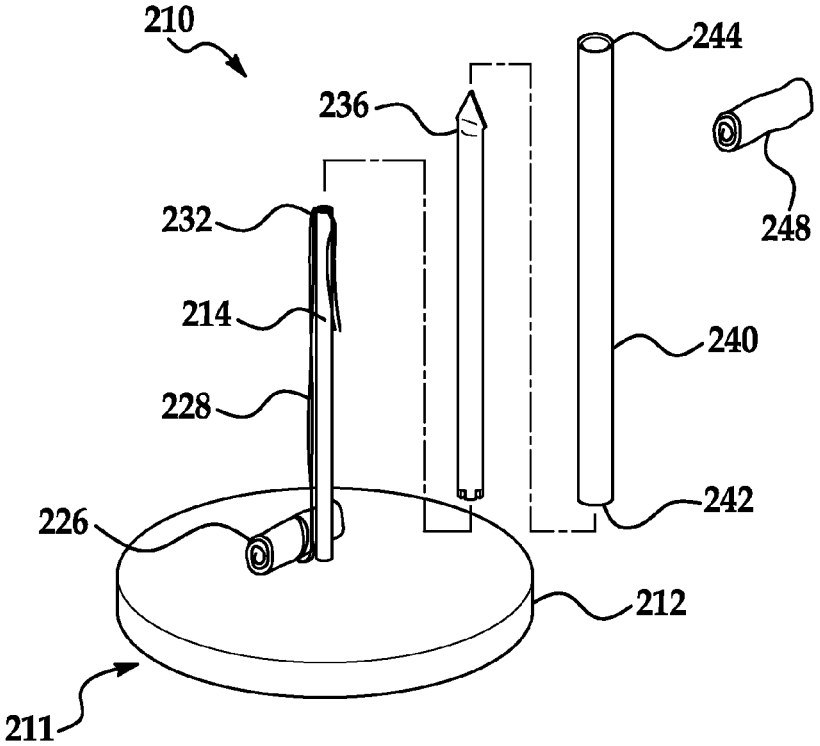
FIG. 9 illustrates an embodiment of the invention where the post is inserted into a circular base.

Illustrated in FIG. 9 is an embodiment of the cardboard baler 210 having a stand 211, a sleeve 236, a ram 240, and a second anchoring element 248. The stand 211 comprises a post 214 extending from a base 212, a first anchoring element 226, and a cord 228. The base 212 is circular, the post 214 being attached at its proximal end to the base 212 near the geometric center of the circle with a glued or a mechanically formed joint, such as a threaded joint, a press-fit joint, and the like. Although the base is circular, it will be appreciated that other shapes are possible. The post 214 is blunt at its distal end. The post 214 has a notch 232 formed in its distal end. The first anchoring element 226 is one of two anchoring elements between which the bale is constrained. The first anchoring element 226 may be, for example, a piece of cardboard that is rolled into a generally cylindrical shape. Attached to the first anchoring element 226 is cord 228 having sufficient length to provide two free ends after the cord 228 is fastened to the post 214 at the notch 232.

A sleeve 236 comprises a rigid cylindrical wall defining an interior region with an opening at one end. The sleeve 236 is removably disposed over the entire length of the post 214. The sleeve 236 is supported at its proximal end by the base 212. The sleeve 236 is formed at its distal end into a piercing element 238, the piercing element 238 being suitably contoured for piercing cardboard and guiding it onto the sleeve 236 wherein the sleeve 236 is longer than the post 214.

The cord 228 is routed through a first defined space that provides a protected passageway between the post 214 and the sleeve 236. The first defined space prevents cardboard sheets from abrading the cord 228 when cardboard sheets are slid over the post 214 toward the base 212. The first defined space is defined by the cavity between the inner wall of the sleeve 236 and the post 214 through which the cord 228 is routed. In the case where the sleeve 236 and post 214 both are circular in cross section, the cavity between them will be generally annular in cross section.

The cord 228 is routed through a second defined space that provides a protected passageway between the region outside the sleeve 236 and the region inside the sleeve 236. The second defined space prevents the sleeve 236 from pinching the cord 228 when the sleeve 236 is disposed over the post 214. The second defined space may be provided by a slot or a plurality of slots formed in the proximal end of the sleeve 236, said slots forming openings through which the cord 228 can pass.

A ram 240 is removably disposed over the sleeve 236. The ram 240 comprises a rigid tubular wall defining an interior region with a first opening 242 at one end and a second opening 244 at the other end. The first opening 242 may be delineated by an edge that is beveled such that the opening is larger at the outer wall than the inner wall. The second opening 244 may be similarly beveled.

A second anchoring element 248 is attached to the free ends of cord 228 to complete the binding of the bale. In more detail, still referring to the invention of FIG. 9, the cardboard baler 210 includes components that are reusable or may be discarded. Excluding the cardboard being baled, the first anchoring element 226, cord 228, and the second anchoring element 248 may be discarded. All other components are reusable. FIGS. 6-7 illustrate the steps in the process of baling cardboard or paper with an embodiment of the invention. Similar steps are used for baling cardboard or paper using the embodiment of cardboard baler 210.

Figure 10:
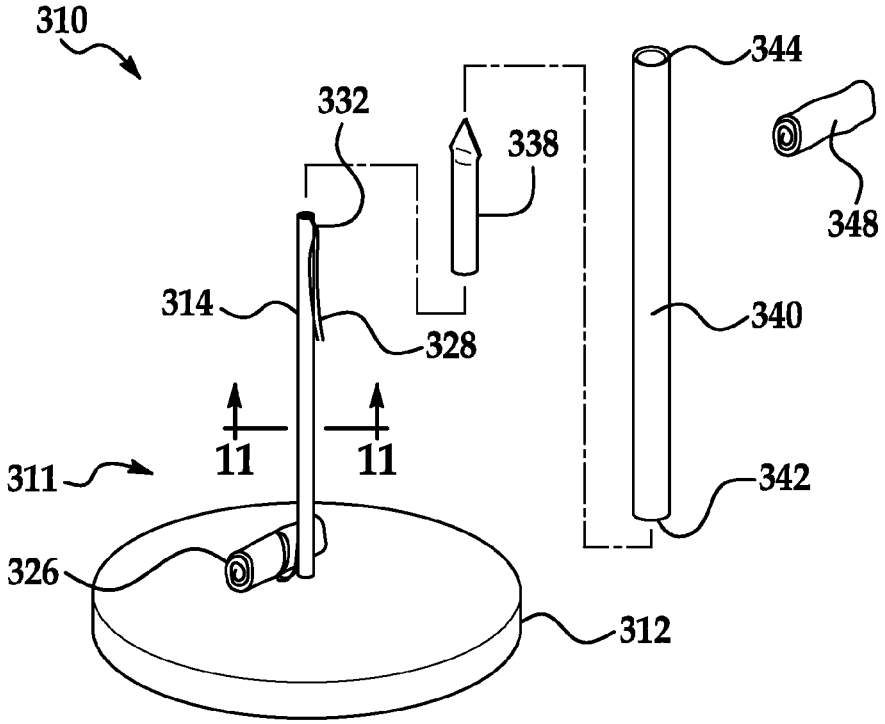
FIG. 10 illustrates an exploded elevation view of an embodiment of the invention where the cord is routed through a slot in the post with FIG. 11 illustrating the cross-sectional view of the post.

An embodiment of the cardboard baler 310 shown in FIG. 10 has stand 311, a piercing element 338, a ram 340, and a second anchoring element 348. The stand 311 comprises a post 314 extending from a base 312, a first anchoring element 326, and a cord 328. The base 312 is circular, the post 314 being attached at its proximal end to the base 312 near the geometric center of the circle with a glued or a mechanically formed joint, such as a threaded joint, a press-fit joint, and the like. Although the base is circular, it will be appreciated that other shapes are possible. The post 314 is blunt at its distal end. The post 314 has a notch 332 formed in its distal end.

The first anchoring element 326 is one of two anchoring elements between which the bale is constrained. The first anchoring element 326 may be, for example, a piece of cardboard that is rolled into a generally cylindrical shape. Attached to the first anchoring element 326 is cord 328 having sufficient length to provide two free ends after the cord 328 is fastened to the post 314 at the notch 332.

A piercing element 338 comprises a rigid cylindrical wall defining an interior region with an opening at one end into which the distal end of the post 314 is received. The piercing element 338 is removably disposed over the distal end of the post 314 and is supported from the inside by the distal end of the post 314. The piercing element 338 is formed at the end opposite the opening into a pointed tip contoured for piercing cardboard and guiding it onto the post 314.

The cord 328 is routed through a defined space that provides a protected passageway along the post 314. A channel formed longitudinally in the post 314 into which a portion of the cord 328 is routed defines the defined space. The defined space prevents cardboard sheets from abrading the cord 328 when cardboard sheets are slid over the post 314 toward the base 312.

A ram 340 is removably disposed over the piercing element 338 and post 314. The ram 340 comprises a rigid tubular wall defining an interior region with a first opening 342 at one end and a second opening 344 at the other end. The first opening 342 may be delineated by an edge that is beveled such that the opening is larger at the outer wall than the inner wall. The second opening 344 may be similarly beveled.

Figure 11:
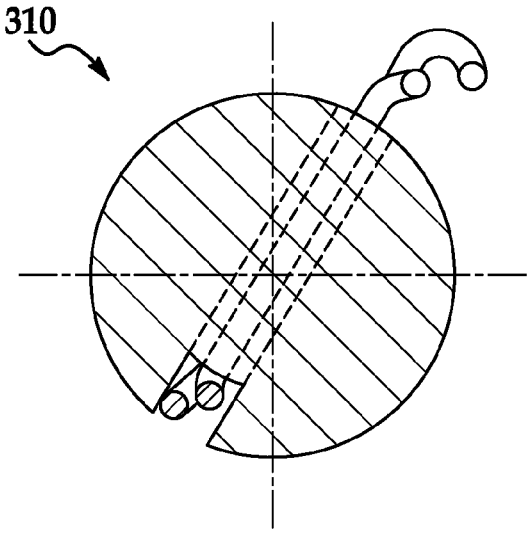

FIG. 11 depicts the cross section view of the post 314.

Figure 12:
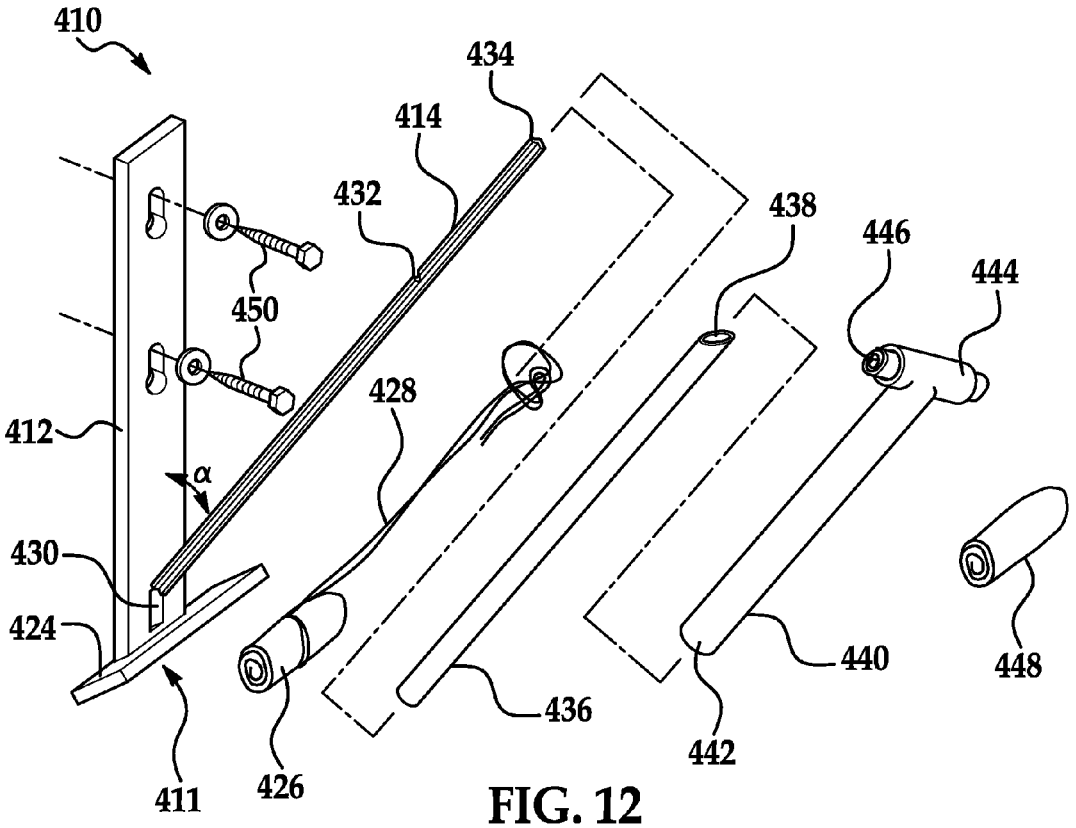
FIG. 12 illustrates an embodiment of the invention where the base 412 is mounted on a vertical structure such as a wall.

Illustrated in FIG. 12 is the embodiment of the cardboard baler 410 having a stand 411, a sleeve 436, a ram 440, and a second anchoring element 448. The stand 411 comprises a post 414 extending from a base 412, a fence 424, a first anchoring element 426, and a cord 428. The base 412 is fixed to a surface, such as a wall, with one or more fasteners 450 and the post is disposed at an angle, $\alpha$, relative to the base 412, the angle ranging from fifteen degrees (15°) to ninety degrees (90°). The post 414 has a piercing element 434 formed at its distal end and is attached to the base 412 at its proximal end.

Additionally, a fence 424 is secured adjacent the base 412. The first anchoring element 426 is one of two anchoring elements between which the bale is constrained. The first anchoring element 426 is made with a piece of cardboard that is rolled into a generally cylindrical shape. Attached to the first anchoring element 426 is a cord 428 having sufficient length to provide two free ends after the cord 428 is fastened to the post 414 at the notch 432.

A sleeve 436 comprises a rigid cylindrical wall defining an interior region with an opening at both ends. The sleeve 436 is removably disposed over the post 414, being supported at the proximal end by the stand 411. The sleeve 436 is cut at an angle at its distal end 438, the angle ranging from fifteen degrees (15°) to ninety degrees (90°) relative to the sleeve axis. The cord 428 is routed through a first defined space included between the post 414 and the sleeve 436 by the cavity between the post 414 and the inner wall of the sleeve 436. The cord 428 is routed through the first defined space. The first defined space prevents the cord 428 from getting abraded by the cardboard sheets when cardboard sheets are slid over the post 414 toward the base 412.

The cord 428 is routed through a second defined space that provides a protected passageway between the region outside the sleeve 436 and the region inside the sleeve 436. The second defined space prevents the sleeve 436 from pinching the cord 428 when the sleeve 436 is disposed over the post 414. The second defined space is provided by a slot 430 formed in the upper surface of the base 412, the slot 430 extending from the region outside the area circumscribed by the wall of the sleeve 436 to the region inside the area circumscribed by the wall of the sleeve 436, thereby forming an opening between the sleeve 436 and the base 412 through which the cord can pass.

A ram 440 comprises a rigid tubular wall defining an interior region with three openings and is removably disposed over a portion of the post 414 and sleeve 436. The ram 440 has an upper tubular portion and a lower tubular portion, the two portions being disposed at right angles forming substantially the shape of a capital letter T. The upper tubular portion corresponds to the horizontal stroke in the capital letter T and the lower tubular portion corresponds to the vertical stroke in the capital letter T. The upper tubular portion and lower tubular portion are joined so as to form a single interior cavity in the shape of a T, the cavity open at both ends of the upper tubular portion 444 and at the bottom opening 442 of the lower tubular portion. Each opening is delineated by an edge adjacent to the inner tube wall and the outer tube wall. In an embodiment of the invention, the bottom opening 442 is delineated by an edge that is beveled such that the opening is larger at the outer wall than the inner wall. A compliant, shock-absorbing element 446 occupies the cavity bounded by the walls of the upper tubular portion in an embodiment of the invention. The shock-absorbing element 446 is of sufficient length to extend entirely across the passageway leading from the upper tubular portion to the lower tubular portion and of sufficient breadth to fit snugly in the upper tubular portion.

A second anchoring element 448 is attached to the free ends of cord 428 to complete the binding of the bale. In an embodiment of the invention, the second anchoring element 448 is a piece of cardboard that is rolled into a generally cylindrical shape.

Figure 13:
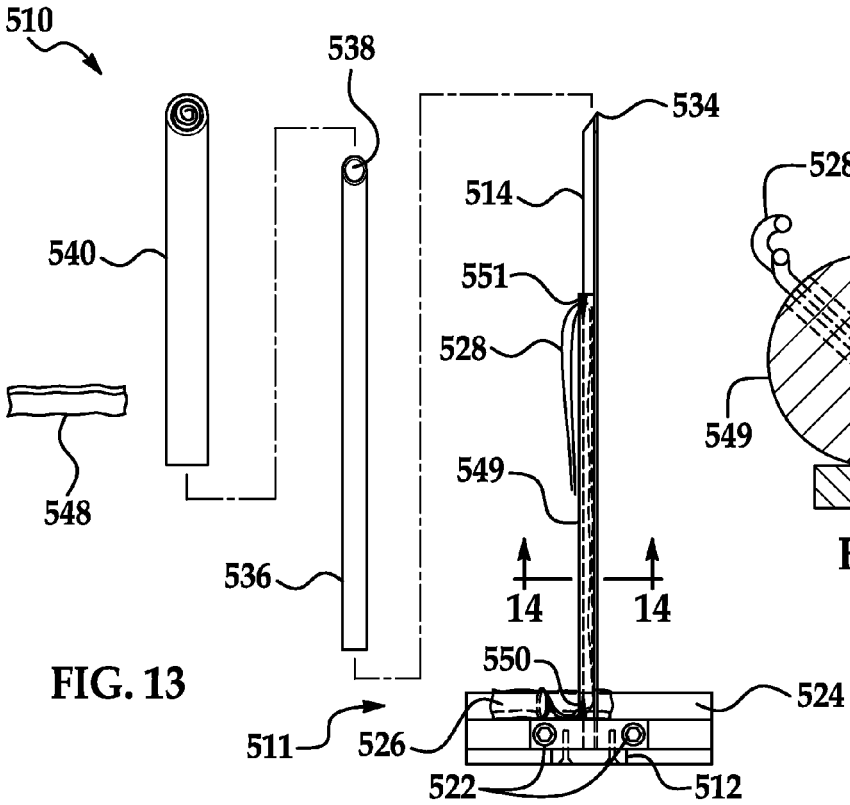
FIG. 13 illustrates an embodiment of the invention.

Illustrated next in FIG. 13 is an embodiment of the cardboard baler 510 having a stand 511, a sleeve 536, a ram 540, and a second anchoring element 548. The stand 511 comprises a primary post 514 extending from a base 512, a secondary post 549, a fence 524, a first anchoring element 526, and a cord 528.

The primary post 514 has a piercing element 534 formed at its distal end and is attached to the base 512 at its proximal end. The secondary post 549 is disposed adjacent to and substantially parallel to the primary post 514. The secondary post 549 has a notch 550 at its proximal end and a notch 551 at its distal end.

The first anchoring element 526 is one of two anchoring elements between which the bale is constrained. In an embodiment of the invention, the first anchoring element 526 is a piece of cardboard that is rolled into a generally cylindrical shape. Attached to the first anchoring element 526 is a cord 528 having sufficient length to provide two free ends after the cord 528 has been routed through the slot 550 at the proximal end of the secondary post 549, alongside the secondary post, and through the slot 551 at the distal end of the secondary post 549. The slot 550 and slot 551 may be tapered to accept and hold a range of diameters for the cord 528.

A sleeve 536 comprises a rigid cylindrical wall defining an interior region with an opening at both ends. The sleeve 536 is removably disposed over the primary post 514 and the secondary post 549, being supported at the proximal end by the stand 511. The sleeve 536 is cut at an angle at its distal end 538, the angle ranging from fifteen degrees (15°) to ninety degrees (90°) relative to the sleeve axis.

The cord 528 is routed through a first defined space that provides a protected passageway between the secondary post 549 and the sleeve 536. The first defined space is created by the cavity between the primary post 514, the secondary post 549, and the inner wall of the sleeve 536 through which the cord 528 is routed. The first defined space prevents cardboard sheets from abrading the cord 528 when cardboard sheets are slid over the primary post 514 and the secondary post 549 toward the base 512.

A ram 540 comprises a rigid tubular wall defining an interior region with three openings. The ram 540 is removably disposed over a portion of the primary post 514 and the sleeve 536. A second anchoring element 548 is attached to the free ends of cord 528 to complete the binding of the bale.

Figure 14:
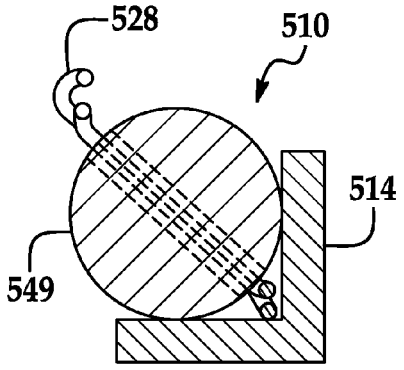
FIG. 14 is the cross-sectional view of the post for the embodiment illustrated in FIG. 13.

FIG. 14 depicts the sectional view through the primary post 514 and the secondary post 549. The primary post 514 has an "L" shaped cross section where one of the arms of the "L" is inserted into a slot within the stationary jaw 516 and the other arm of the "L" is tightly sandwiched between the movable jaw 518 and stationary jaw 516 tightened with a pair of fasteners 522 so that primary post 514 is held in an upright and stable position. The sectional view also depicts the relationship between the primary post 514 having an "L" shaped cross section and the secondary post 549 having a circular cross section. The cord 528 runs through the first defined space or cavity formed as the circular cross sectioned secondary post 549 is placed adjacent to the "L" shaped cross sectioned primary post 514.

An embodiment of the apparatus for baling cardboard comprises of a base a jaw attached to the base where the jaw includes a housing cavity; a primary post in substantially cylindrical conformation having a cross-sectional shape, a primal end and a distal end where the primal end and the distal end of the primary post are linearly disposed, where the primal end of the primary post is adapted to fit into and engage the housing cavity included in the jaw; a secondary post in a substantially cylindrical conformation having a cross-sectional shape, a primal end and a distal end where the primal end and the distal end of the secondary post are linearly disposed and the distal end of the secondary post has a notch, where the primary post and the secondary post are disposed adjacent to each other with their respective axes running in parallel, and the cross section shaped of the primary and the secondary posts adapted to create a first defined space where the first defined space runs parallel to the axes of the primary and the secondary posts; a cord of predetermined length having a first end, a middle section, and a second end and adapted to run through a bale of cardboard where the first end of the cord is attached to a first anchoring element and the second end of the cord is attached to the notch in the distal end of the secondary post and where the middle section of the cord is encapsulated within the first defined space; a sleeve that is substantially shaped as a hollow cylinder having a diameter and a length where the diameter of the sleeve is adapted to collectively fit over the primary and the secondary post where the sleeve is adapted to cover the primary and the secondary post; and a second anchoring element adapted to attach to the second end of the cord. In an embodiment of the invention the cross sectional shape of the primary post is that of an "L" and the cross sectional shape of the secondary post is a circle.

Figure 15:
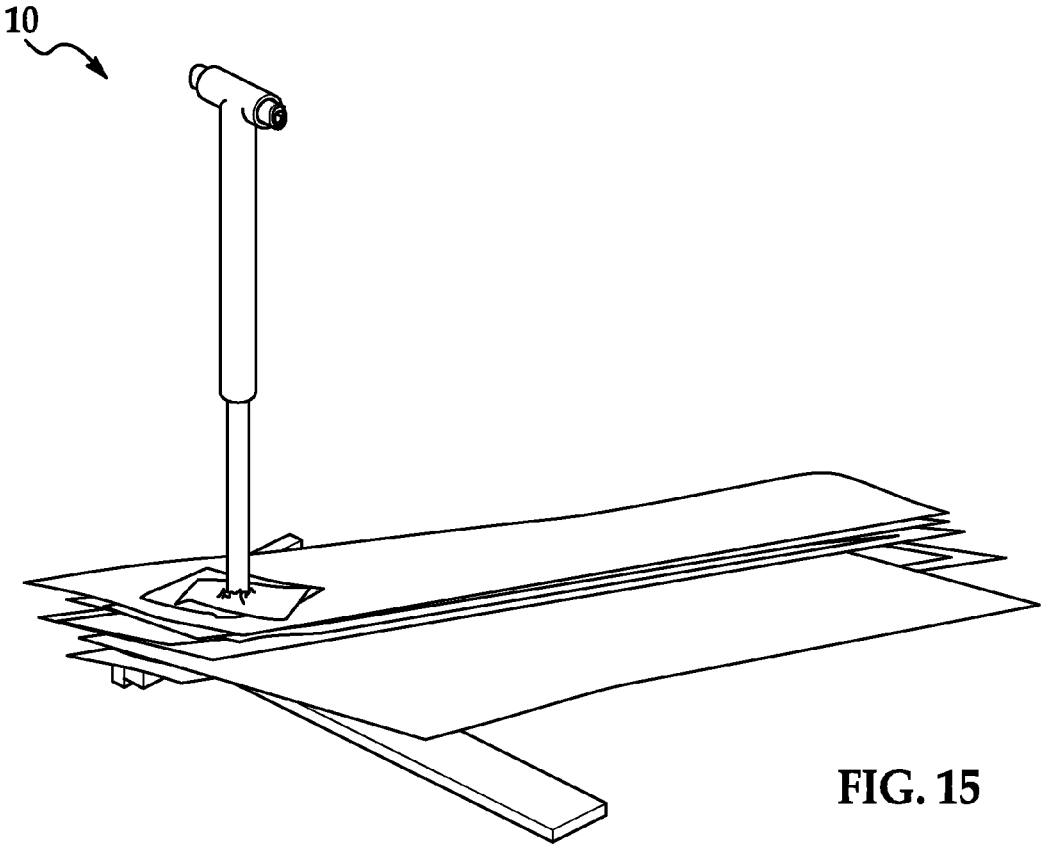
FIG. 15 is an illustration where an embodiment of the invention is used to bale cardboard pieces of unequal and non-uniform sizes.

Illustrated in FIG. 15 the use of the cardboard baler in an application where the cardboard pieces being baled have non-uniform and unequal size.

Figure 16:
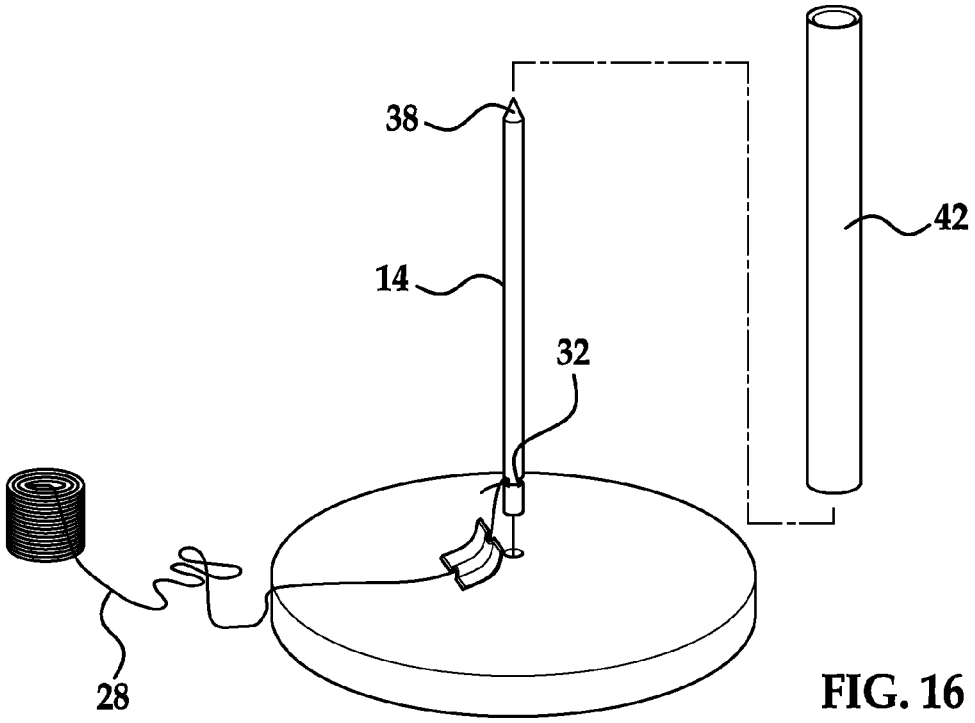
FIG. 16 is an embodiment of the invention without the use of anchoring elements where the two ends of a cord running through the bale are tied over the surface of the bale.

FIG. 16 illustrates an embodiment of the invention where the baler does not utilize any anchoring elements. Instead, the cord 28 is passed through the center of the cardboard being baled. The cord 28 is of sufficient length so that the two ends of the cord are knotted together over one of the edges of the bale 58.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the embodiments of the invention without departing from the spirit and scope of the appended claims. The foregoing description is illustrative of particular embodiments of the invention, but is not meant to be a limitation upon the practice thereof. The following claims, including all equivalents thereof, are intended to define the scope of the invention.

What is claimed is:

1. An apparatus for baling cardboard comprising:

a base;

a post having a primal end, a middle section, and a distal end where the primal end, the middle section and the distal end are linearly disposed, and the primal end of the post is attached to the base and the post has a notch and a piercing element;

a first anchoring element located at the primal end of the post;

a cord of predetermined length having a first end and a second end and configured to run through a bale of cardboard where the first end of the cord is attached to the first anchoring element and the second end of the cord is attached to the notch in the post;

a sleeve having a primal end and a distal end with the primal end of the sleeve configured to cover the primal end of the post and the distal end of the sleeve configured to cover the post, where the sleeve is substantially shaped as a hollow cylinder having a diameter and the post and the cord are located within a hollow cavity along a length of the hollow cylinder, and the length of the sleeve is configured to cover the post and the cord is routed through a defined space that provided a protected passageway between the post and the sleeve; and a second anchoring element configured to attach to the second end of the cord to complete the binding of the bale.

2. The apparatus for baling cardboard of claim 1, further comprising:

a jaw attached to the base where the jaw includes a housing cavity and the post is inserted into the housing cavity of the jaw, wherein the conformation of the post and jaw attached to the base includes an angle between the base and the post, and the included angle between the post and the base ranges between fifteen (15) degrees to ninety (90) degrees.

3. The apparatus for baling cardboard of claim 1, further comprising:

the piercing element disposed over the distal end of the post with the piercing element comprising of a tapered feature where the piercing element is attached to and supported by the distal end of the post and includes a pointed contour with the pointed contour extending beyond the distal end of the post.

4. The apparatus for baling cardboard of claim 1, further comprising:

a piercing element disposed over the distal end of the sleeve with the piercing element comprising of a tapered feature where the piercing element is attached to and supported by the distal end of the sleeve and includes a pointed contour with the pointed contour extending beyond the distal end of the post.

5. The apparatus for baling cardboard of claim 1, further comprising a first defined space where the first defined space is formed by the region between the post and the sleeve, and a portion of the cord is run alongside the post and through the first defined space.

6. The apparatus for baling cardboard of claim 1, further comprising:

a jaw attached to the base where the jaw includes a housing cavity and the post is inserted into the housing cavity of the jaw, with the post having a cross section shape and where the cross section shape of the post has a shape of an "L" and wherein the housing cavity in the jaw is adapted to receive the post with the "L" cross section shape.

7. The apparatus for baling cardboard of claim 1, further comprising:

a jaw attached to the base where the jaw includes a housing cavity and the post is inserted into the housing cavity of the jaw, with the post having a cross section shape and where the cross section shape of the post has a shape of an "T" and wherein the housing cavity in the jaw is adapted to receive the post with the "T" cross section shape.

8. The apparatus for baling cardboard of claim 1 where the base includes a surface and a device for mounting the base on a mounting surface where the device for mounting the base on the mounting surface includes a plurality of fasteners that pierce through the base surface and insert into the mounting surface thereby fastening the base and the mounting surface.

9. The apparatus for baling cardboard of claim 1 where the base has a shape selected from a group consisting of a circle, an ellipse, a rectangle, a trapezoid and a square.

10. The apparatus for baling cardboard of claim 1, further comprising:

a jaw attached to the base where the jaw includes a housing cavity and the post is inserted into the housing cavity of the jaw, wherein the jaw comprises of a stationary jaw portion and a movable jaw portion where the stationary jaw portion is fixedly attached to the base;

the movable jaw portion has a first end and a second end where the first end of the movable jaw portion is detachably attached to a fence and the second end the movable jaw portion is detachably attached to the stationary jaw portion; and the attachment of the movable jaw portion and the stationary jaw portion includes the housing cavity.

11. The apparatus for baling cardboard of claim 10, further comprising:

a fastening mechanism for fixedly attaching the stationary jaw portion to the base;

the movable jaw portion and the stationary jaw portion each having a surface where the surfaces come into a contact with each other creating a hollow cavity that is complimentarily shaped and adapted to accommodate the post to fully engage and occupy the hollow cavity;

a clamping mechanism utilizing one or more threaded fasteners for attaching the movable jaw portion to the stationary jaw portion where the clamping mechanism is adapted to vary the force exerted by the movable jaw portion and the stationary jaw portion over the accommodated post.

12. The apparatus for baling cardboard of claim 11, further comprising:

the movable jaw portion having a jaw height and a left end and a right end where the right end of the movable jaw portion engages the stationary jaw portion and the left end of the movable jaw portion includes the fence having a fence height where the fence height is larger than the jaw height;

the fence attached to the left end of the movable jaw portion with the clamp; and the fence height is adapted to restrain a first anchoring element in close proximity to the post.

13. The apparatus for baling cardboard of claim 1 that includes a ram adapted to cover the sleeve and the post included therein and wherein the ram comprises:

an upper portion and a lower portion with each of the upper portion and the lower portion having a hollow cylindrical shape, where the upper portion and lower portion are fixedly attached so as form a shape of a letter "T" with the upper portion aligned with horizontal arm of the letter "T" and the lower portion aligned with vertical arm of the letter "T";

the upper portion is stuffed with compliant or shock absorbing material; and the lower portion having a top end and a bottom end where the top end of the lower portion is fixedly attached to the upper portion, and the lower end has an opening where the opening includes beveled edge circumscribing the perimeter of the opening.

14. An apparatus for baling cardboard comprising:

a base;

a jaw attached to the base where the jaw includes a housing cavity;

a primary post having a cross-sectional shape, a primal end, a piercing element, and a distal end where the primal end and the distal end of the primary post are linearly disposed, where the primal end of the primary post is configured to fit into and engage the housing cavity included in the jaw;

a secondary post in a substantially cylindrical conformation having a cross-sectional shape, a primal end and a distal end where the primal end and the distal end of the secondary post are linearly disposed and the distal end of the secondary post has a notch, where the primary post and the secondary post are disposed adjacent to each other with their respective axes running in parallel, and the cross section shaped of the primary and the secondary posts configured to create a first defined space where the first defined space runs parallel to the axes of the primary and the secondary posts;

a cord of predetermined length having a first end, a middle section, and a second end and configured to run through a bale of cardboard where the first end of the cord is attached to a first anchoring element and the second end of the cord is attached to the notch in the distal end of the secondary post, and where the middle section of the cord is encapsulated within the first defined space;

a sleeve that is substantially shaped as a hollow cylinder having a diameter and a length where the diameter of the sleeve is configured to fit over the adjacently disposed primary and the secondary posts and the sleeve is configured to cover the primary and the secondary post; and a second anchoring element configured to attach to the second end of the cord to complete the binding of the bale.

15. The apparatus for baling cardboard of claim 14 where the cross sectional shape of the primary post is that of an "L" and the cross sectional shape of the secondary post is a circle.

16. The apparatus for baling cardboard of claim 14, further comprising:

the piercing element disposed over the distal end of the primary post with the piercing element comprising of a tapered feature where the piercing element is attached to and supported by the distal end of the primary post and includes a pointed contour with the pointed contour extending beyond the distal end of the primary post.

17. The apparatus for baling cardboard of claim 14, further comprising:

a piercing element disposed over the distal end of the sleeve with the piercing element comprising of a tapered feature where the piercing element is attached to and supported by the distal end of the sleeve and includes a pointed contour with the pointed contour extending beyond the distal end of the post.

18. The apparatus for baling cardboard of claim 14 that includes a ram adapted to cover the sleeve and the adjacently disposed primary and secondary posts included therein and wherein the ram comprises an upper portion and a lower portion with each of the upper portion and the lower portion having a hollow cylindrical shape, where the upper portion and lower portion are fixedly attached so as to form a shape of a letter "T" with the upper portion aligned with horizontal arm of the letter "T" and the lower portion aligned with vertical arm of the letter "T";

the upper portion is stuffed with compliant or shock absorbing material;

the lower portion having a top end and a bottom end where the top end of the lower portion is fixedly attached to the upper portion, and the lower end has an opening where the opening includes beveled edge circumscribing the perimeter of the opening.

19. A method for baling of material, comprising the steps of:

providing an apparatus for baling cardboard or cellulosic material where the apparatus is comprised of a base, a post having a length and a proximal end and a distal end, with the proximal end of the post attached to the base, a piercing element extending beyond the distal end of the post, a cord having a first end and a second end and predetermined length, the first end of the cord attached to a first anchoring element and connected to the primal end of the post, and the second end of the cord attached to a notch included on the post, and a removable sleeve covering the post from the proximal end to the distal end;

providing a plurality of pieces of cardboard or cellulosic material to be baled; attaching the first end of the cord to the first anchoring element;

routing the cord through a set of defined spaces along the post and attaching the cord to the notch on the post;

impaling the plurality of pieces of cardboard or cellulosic material over the piercing element;

sliding the plurality of pieces of cardboard or cellulosic material along the length of the post and the cord optionally with the help of a ram used for pushing the plurality of pieces of cardboard or cellulosic material down towards to the proximal end of the post thereby building a stack of the plurality of pieces of cardboard or cellulosic material at the proximal end of the post;

compressing the stack of the plurality of pieces cardboard or cellulosic material with a predetermined force of the ram;

detaching said cord from the notch on the post and attaching it to a second anchoring element thereby forming a bundle of the plurality of cardboard or cellulosic material compressed between the first and the second anchoring element; and removing the bundle from the post.

20. The method according to claim 19, further comprising the steps of:

installing the sleeve to cover the post prior to impaling the plurality of pieces of cardboard or cellulosic material over the piercing element; and removing the sleeve from the post after sliding the plurality of pieces of cardboard or cellulosic material along the length of the sleeve covering the post.

* * * * *